US008177928B2

(12) United States Patent
Ohki

(10) Patent No.: US 8,177,928 B2
(45) Date of Patent: May 15, 2012

(54) METHOD OF RESTRAINED-QUENCHING OF ANNULAR MEMBER

(75) Inventor: Chikara Ohki, Kuwana (JP)

(73) Assignee: NTN Corporation, Osaka (JP)

( * ) Notice: Subject to any disclaimer, the term of this patent is extended or adjusted under 35 U.S.C. 154(b) by 244 days.

(21) Appl. No.: 12/442,030

(22) PCT Filed: Aug. 21, 2007

(86) PCT No.: PCT/JP2007/066159

§ 371 (c)(1),
(2), (4) Date: Mar. 19, 2009

(87) PCT Pub. No.: WO2008/035524

PCT Pub. Date: Mar. 27, 2008

(65) Prior Publication Data

US 2009/0260721 A1 Oct. 22, 2009

(30) Foreign Application Priority Data

Sep. 20, 2006 (JP) ..... 2006-254301
Sep. 20, 2006 (JP) ..... 2006-254556
Sep. 22, 2006 (JP) ..... 2006-257330

(51) Int. Cl.
*C21D 9/40* (2006.01)

(52) U.S. Cl. ..... 148/646; 148/589; 148/647

(58) Field of Classification Search ..... 148/589, 148/646, 647
See application file for complete search history.

(56) References Cited

FOREIGN PATENT DOCUMENTS

| | | |
|---|---|---|
| JP | 62-037315 | 2/1987 |
| JP | 3-170617 | 7/1991 |
| JP | 9-176740 | 7/1997 |
| JP | 2005-163060 | 6/2005 |
| JP | 2007-138222 | 6/2007 |

OTHER PUBLICATIONS

English language machine translation of JP 2005-163060.*

* cited by examiner

*Primary Examiner* — Stanley Silverman
*Assistant Examiner* — Brian Walck
(74) *Attorney, Agent, or Firm* — McDermott Will & Emery LLP

(57) ABSTRACT

A method of restrained-quenching of an annular member, that can readily ensure a sufficient effect of restraint, increase treatment efficiency of a quench hardening treatment, and suppress production cost of the annular member, includes a heating step, a first cooling step, a restraint step, and a second cooling step. In the heating step, a bearing ring formed as the annular member is heated to a temperature not lower than an $A_1$ point. In the first cooling step, the bearing ring is cooled to a first cooling temperature not higher than an $M_S$ point. In the restraint step, the bearing ring is restrained with a restraint member. In the second cooling step, the bearing ring is cooled to a second cooling temperature lower than a restraint start temperature while it remains restrained. Then, in the restraint step and the second cooling step, the bearing ring is restrained at a ridgeline portion without the bearing ring and the restraint member being in contact with each other at an outer circumferential surface and an end surface of the bearing ring.

14 Claims, 8 Drawing Sheets

METHOD OF RESTRAINED-QUENCHING OF ANNULAR MEMBER

RELATED APPLICATIONS

This application is the U.S. National Phase under 35 U.S.C. §371 of International Application No. PCT/JP2007/066159, filed on Aug. 21, 2007, which in turn claims the benefit of Japanese Application No. 2006-254301, filed on Sep. 20, 2006, Japanese Application No. 2006-254556, filed on Sep. 20, 2006, and Japanese Application No. 2006-257330, filed on Sep. 22, 2006, the disclosures of which Applications are incorporated by reference herein.

TECHNICAL FIELD

The present invention relates to a method of restrained-quenching of an annular member, and more particularly to a method of restrained-quenching of an annular member, for suppressing deformation by restraining an annular member.

BACKGROUND ART

In a quench hardening treatment of an annular member such as a bearing ring, in order to suppress deformation during heat treatment (heat treatment deformation) or poor circularity, restrained quenching in which cooling in quenching is performed while the annular member is restrained may be adopted in some cases. This restrained quenching utilizes expansion of steel forming the annular member through martensitic transformation during quenching. Namely, cooling in quenching is performed while the annular member is surrounded by a restraint member so that the annular member expands along a wall surface of the restraint member and the annular member in a desired shape can be obtained. According to this method, however, an inner wall of the restraint member and the annular member come in intimate contact with each other at the time point when cooling in restrained quenching ends. Then, it is difficult to separate the annular member from the restraint member, and efficiency of the quench hardening treatment may lower.

In order to address this, a restrained-quenching method has been proposed, in which a restraint member having annular openings in upper and lower portions and having an inner wall like a cylinder is adopted, the annular member is successively pushed in from the upper opening, the annular member is cooled, and the cooled annular member is pushed out of the lower opening. Thus, the annular member is successively separated from the restraint member and lowering in efficiency of the quench hardening treatment can be suppressed (Japanese Patent Laying-Open No. 9-176740 (Patent Document 1)).

Patent Document 1: Japanese Patent Laying-Open No. 9-176740

DISCLOSURE OF THE INVENTION

Problems to be Solved by the Invention

According to the conventional restrained-quenching method including the restrained-quenching method described in Patent Document 1, in which the annular member is restrained by bringing the wall surface of the restraint member in intimate contact with an outer circumferential surface or an inner circumferential surface of the annular member, however, a dimension at the time point when restraint of the annular member is started should accurately be expected in advance. Namely, if the dimension of the annular member at the time point when restraint is started is greater than a space surrounded by the wall surface of the restraint member, restraint itself is impossible. On the other hand, if the dimension of the annular member at the time point when restraint is started is too smaller than the space surrounded by the wall surface of the restraint member, the annular member is not sufficiently restrained with the restraint member even though the annular member expands during quenching.

In addition, according to the conventional restrained-quenching method above, even when the dimension of the annular member at the time point when restraint is started can accurately be expected, a restraint member having a dimension in accordance with a dimension of an annular member to be quenched should be prepared for each dimension of that annular member. Moreover, in an actual production line, the restraint member to be used should be replaced each time the dimension of the annular member to be quenched is changed and efficiency of quenching treatment becomes lower.

As described above, the conventional restrained-quenching method has suffered from such problems as necessity to accurately expect a dimension of an annular member in order to ensure a sufficient effect of restraint or to prepare a large number of restraint members, and bothersome replacement of the restraint member (tool change). The problems above make it difficult to ensure a sufficient effect of restraint, lower treatment efficiency of the quench hardening treatment, and cause increase in production cost of the annular member.

An object of the present invention is to provide a method of restrained-quenching of an annular member, that can readily ensure a sufficient effect of restraint, increase treatment efficiency of quench hardening treatment, and suppress production cost of the annular member.

Means for Solving the Problems

A method of restrained-quenching of an annular member according to the present invention includes the steps of: heating an annular member made of steel to a temperature not lower than an $A_1$ point (heating step); cooling the annular member heated to the temperature not lower than the $A_1$ point, from the temperature not lower than the $A_1$ point to a first cooling temperature which is a temperature not higher than an $M_S$ point (a first cooling step); restraining the annular member cooled to the first cooling temperature with a restraint member (a restraint step); and cooling the annular member restrained with the restraint member to a second cooling temperature which is a temperature lower than a restraint start temperature at which restraint with the restraint member is started and not higher than the $M_S$ point, while the annular member remains restrained with the restraint member (a second cooling step). In the step of restraining the annular member and the step of cooling the annular member to the second cooling temperature, the annular member is restrained such that the restraint member and the annular member are in contact with each other at a ridgeline portion which is a portion where an outer circumferential surface and at least one end surface out of one end surface and the other end surface of the annular member intersect with each other, without the annular member and the restraint member being in contact with each other at that at least one end surface and at the outer circumferential surface of the annular member.

In general, in cooling in restrained quenching of the annular member, the annular member is restrained such that the outer circumferential surface and the end surface of the annular member are in contact with the restraint member in its entirety. In contrast, the present inventor has studied in detail relation of a restrained portion in restrained quenching of the annular member with dimension accuracy and circularity of the quenched annular member. Consequently, the present inventor has obtained the following conception.

Specifically, the present inventor has found that, in cooling in restrained quenching of the annular member, sufficient dimension accuracy and circularity can be obtained if the annular member is restrained such that the restraint member and the annular member are in contact with each other at the ridgeline portion where the outer circumferential surface and the end surface of the annular member intersect with each other, without the annular member and the restraint member being in contact with each other at the outer circumferential surface and the end surface of the annular member, and that sufficient dimension accuracy and circularity can be obtained if restraint at the ridgeline portion is carried out only on one side, namely, restraint at the ridgeline portion does not necessarily have to be carried out at ridgeline portions adjacent to end surfaces on opposing sides.

In the method of restrained-quenching of the annular member according to the present invention, the annular member made of steel austenitized as a result of heating to the temperature not lower than the $A_1$ point in the heating step starts martensitic transformation by being cooled to the first cooling temperature not higher than the $M_S$ point in the first cooling step. Here, martensitic transformation of steel does not proceed unless the temperature is lowered. In addition, if steel is cooled to a temperature not higher than the $M_S$ point, transformation to pearlite and transformation to bainite do not proceed either. In the restraint step, the annular member is restrained at the ridgeline portion, and in the second cooling step, the annular member is cooled further to the second cooling temperature. Then, martensitic transformation proceeds and the annular member is hardened while poor circularity and heat treatment deformation are suppressed.

Here, for example, a restraint member of which restraint surface implemented as a wall surface for contact with the annular member is circular in a cross-section at a plane perpendicular to one axis or a restraint member of which restraint surface has a portion inclined with respect to one axis, specifically a restraint member having a restraint surface in a conical surface shape or a spherical shape, is adopted. Then, the annular member can be restrained at the ridgeline portion, without accurately expecting in advance a dimension of the annular member at the restraint start time point, by bringing the restraint surface of the restraint member in contact with the ridgeline portion of the annular member such that the one axis of the restraint member coincides with the axis of the annular member. Meanwhile, sufficient dimension accuracy and circularity can be obtained as a result of restraint of the annular member such that the restraint member and the annular member are in contact with each other at the ridgeline portion as described above. Therefore, a sufficient effect of restraint can readily be ensured.

In addition, as a result of restraint of the annular member at the ridgeline portion as described above, for example by adopting a restraint member as described above, it is not necessary to prepare a restraint member having a shape of a restraint surface (a diameter of a cross-section perpendicular to one axis) in conformity with the annular member for each dimension thereof, and one restraint member can be used for restraining annular members of various dimensions. Moreover, in the actual production line as well, it is not necessary to replace the restraint member to be used each time the dimension of the annular member to be quenched is changed, and efficiency of quenching treatment is improved. Therefore, treatment efficiency of the quench hardening treatment can be enhanced and production cost of the annular member can be suppressed.

As described above, according to the method of restrained-quenching of the annular member of the present invention, a sufficient effect of restraint can be ensured, treatment efficiency of the quench hardening treatment can be enhanced, and the production cost of the annular member can be suppressed readily.

A restraint member to be adopted should only be such a restraint member that its restraint surface has a circular cross-section perpendicular to an axial direction, for example, a conical surface shape and a spherical shape, and has a wall surface of which cross-sectional diameter gets continuously smaller (or greater) in the axial direction. In addition, an angle between the plane perpendicular to the axis and the restraint surface (restraint member taper angle) at a portion of contact between the restraint member and the annular member at the cross-section including the axis of the restraint member is ideally set to 45 degrees in consideration of balance between restraining force in the radial direction and restraining force in the axial direction, however, variation of approximately ±0.5 degrees should be allowed in consideration of working accuracy or the like of the restraint member, and the angle can be set to an angle not smaller than 44.5 degrees and not greater than 45.5 degrees. In addition, in the restraint step and the second cooling step, an inner circumferential surface of the annular member may be restrained, however, it is not necessary to do so, because the sufficient effect of restraint can be ensured basically by restraining the ridgeline portion above.

Here, the $A_1$ point refers to a point corresponding to a temperature at which steel structure starts transformation from ferrite to austenite as the steel is heated. In addition, the $M_S$ point refers to a point corresponding to a temperature at which the austenitized steel starts transformation to martensite as it is cooled.

In the method of restrained-quenching of the annular member above, preferably, in the step of restraining the annular member with the restraint member and the step of cooling the annular member to the second cooling temperature, the annular member is restrained with the restraint member having a restraint member taper angle not smaller than 44.5 degrees and not greater than 45.5 degrees under load not lower than load L satisfying relation of $$L=3.175\times(C_2/C_1)^{-1.754}\times S \quad (1)$$

where L represents a load (N), S represents a cross-sectional area ($mm^2$) of one cross-section of two separated cross-sections in a cross-section of the annular member including an axis, $C_1$ represents circularity (μm) of the annular member before restraint, and $C_2$ represents circularity (μm) of the annular member required after quenching.

As a result of studies conducted by the present inventor, it became evident that, when circularity of the annular member before restraint is denoted by $C_1$ and the restraint member having a restraint member taper angle of 45 degrees ±0.5 degrees (not smaller than 44.5 degrees and not greater than 45.5 degrees) restrains the annular member, load not lower than load L expressed in Equation (1) above is necessary in order to improve circularity to $C_2$ after quenching. Therefore, by restraining the annular member under load not lower than load L, circularity can be improved to desired circularity $C_2$.

It is noted that circularity ($C_1$) of the annular member before restraint is substantially the same as circularity before starting quench hardening treatment (before heating). Therefore, circularity before starting quench hardening treatment (before heating) may be adopted in Equation (1), instead of circularity ($C_1$) of the annular member before restraint. Here, circularity refers to circularity based on the least squares circle (LSC) method defined under JIS B7451.

In the method of restrained-quenching of the annular member above, the restraint start temperature is a temperature not higher than the $M_S$ point, and in the step of restraining the annular member with the restraint member and the step of cooling the annular member to the second cooling temperature, the annular member may be restrained such that the restraint member and the annular member are in contact with each other at the ridgeline portion which is a portion at which the outer circumferential surface and one end surface of the annular member intersect with each other and the annular member and the restraint member are in contact with each other at the other end surface, without the annular member and the restraint member being in contact with each other at the outer circumferential surface and one end surface above of the annular member.

The present inventor has found that sufficient dimension accuracy and circularity can be obtained by applying restraint at the ridgeline portion only on one side and restraining the end surface on the other side. Therefore, according to the method of restrained-quenching of the annular member of the present invention above, a sufficient effect of restraint can be ensured, treatment efficiency of the quench hardening treatment can be enhanced, and the production cost of the annular member can be suppressed readily.

In the method of restrained-quenching of the annular member above, if the annular member has such a tapered shape that a thickness in a radial direction is different in an axial direction, in the step of restraining the annular member with the restraint member and the step of cooling the annular member to the second cooling temperature, the annular member may be restrained with the end surface of the annular member on a side greater in thickness being defined as one end surface above and the end surface thereof on a side smaller in thickness being defined as the other end surface.

It became evident through the studies conducted by the present inventor that, in the method of restrained-quenching of the annular member in which the ridgeline portion of the annular member is restrained only on one side in the axial direction, in the case the restrained annular member has a tapered shape, by restraining the ridgeline portion adjacent to the end surface of the annular member on the side greater in thickness in a radial direction (ridgeline portion adjacent to the end surface of the annular member closer to a portion greater in thickness in a radial direction), dimension accuracy and circularity superior to the case where the ridgeline portion adjacent to the end surface on the side smaller in thickness in the radial direction is restrained can be obtained. Therefore, in the case where the annular member has a tapered shape, by restraining the annular member with the end surface of the annular member on the side greater in thickness being defined as one end surface and the end surface thereof on the side smaller in thickness being defined as the other end surface, a sufficient effect of restraint can more reliably be ensured.

In the method of restrained-quenching of the annular member above, the restraint start temperature is a temperature not higher than the $M_S$ point, and in the step of restraining the annular member with the restraint member and the step of cooling the annular member to the second cooling temperature, the restraint member and the annular member may be in contact with each other at two ridgeline portions which are portions at which the outer circumferential surface and two end surfaces of the annular member intersect with each other, without the annular member and the restraint member being in contact with each other at the outer circumferential surface and two end surfaces of the annular member. Here, the annular member is preferably restrained such that the restraint member taper angle and the thicknesses of the annular member in the radial direction at the two end surfaces satisfy relation in $$0.9\times(b/a)\leqq(\sin\beta/\sin\alpha)\leqq1.1\times(b/a) \quad (2)$$

where $\alpha$ and $\beta$ represent restraint member taper angles on a side of one end surface and a side of the other end surface out of the two end surfaces above of the annular member respectively, and a and b represent thicknesses in the radial direction at one end surface and the other end surface out of the two end surfaces above of the annular member respectively.

In restrained quenching of the annular member, it is necessary to suppress not only circularity described above but also such deformation (leaning deformation) that an outer circumferential surface or an inner circumferential surface of the annular member is inclined with respect to the axis in a cross-section including the axis of the annular member due to uneven increase or decrease in a diameter of the annular member in the axial direction through the quench hardening treatment. The present inventor has found that leaning deformation can effectively be suppressed by restraining the annular member such that the restraint member taper angle and the thicknesses in the radial direction at two end surfaces of the annular member satisfy the relation shown in Equation (2) described above. Therefore, according to the method of restrained-quenching of the annular member of the present invention, a sufficient effect of restraint can be ensured, treatment efficiency of the quench hardening treatment can be enhanced, and the production cost of the annular member can be suppressed readily.

In the method of restrained-quenching of an annular member above, preferably, the restraint start temperature is not lower than 150° C. As described above, in the method of restrained-quenching of an annular member according to the present invention, poor circularity and heat treatment deformation of the annular member are suppressed as a result of progress of martensitic transformation of steel forming the annular member through cooling of the annular member while it is restrained. If the restraint start temperature is lower than 150° C., however, martensitic transformation has already proceeded to a considerable extent before restraint is started and a ratio of austenite that transforms to martensite after restraint is started is low. Accordingly, an effect of suppressing heat treatment deformation and poor circularity through restraint becomes insufficient. By setting the restraint start temperature to 150° C. or higher, a ratio of austenite that transforms to martensite after restraint is started is sufficiently ensured, and heat treatment deformation and poor circularity of the annular member are further suppressed.

In the method of restrained-quenching of an annular member above, preferably, the second cooling temperature is not higher than 100° C. If restraint of the annular member ends at a temperature higher than 100° C., a ratio of austenite that newly transforms to martensite during subsequent cooling is great and heat treatment deformation or poor circularity may be caused during subsequent cooling. By setting the second cooling temperature to 100° C. or lower, the ratio of austenite that subsequently transforms to martensite can sufficiently be suppressed and heat treatment deformation and poor circularity of the annular member can further be suppressed. If restraint of the annular member is continued until the temperature reaches an $M_f$ point of steel forming the annular member, there will be no residual austenite and poor circularity or heat treatment deformation during subsequent cooling can substantially completely be avoided. Therefore, further effect cannot be expected even when the annular member is cooled to a temperature range lower than the $M_f$ point, which results in lower efficiency of the quench hardening treatment. Therefore, the second cooling temperature can be set to a temperature not lower than the $M_f$ point. Here, the $M_f$ point refers to a point corresponding to a temperature at which transformation to martensite is completed during cooling of austenitized steel.

In the method of restrained-quenching of an annular member above, preferably, a cooling rate in the step of cooling the annular member to the second cooling temperature is not higher than 6° C./second.

By setting the cooling rate in the second cooling step to 6° C./second or lower, poor circularity or heat treatment deformation can further be suppressed. If the cooling rate is lower than 1° C./second, an effect to suppress heat treatment deformation or poor circularity is saturated, while a period of time required for the second cooling step becomes longer, which results in lower treatment efficiency of the quench hardening treatment. Therefore, the cooling rate in the second cooling step is preferably set to 1° C./second or higher. Here, the cooling rate refers to lowering in a temperature per unit time.

Effects of the Invention

As can clearly be understood from the description above, according to the method of restrained-quenching of the annular member of the present invention, a method of restrained-quenching of an annular member, that can readily ensure a sufficient effect of restraint, enhance treatment efficiency of the quench hardening treatment, and suppress production cost of the annular member, can be provided.

DESCRIPTION OF THE REFERENCE SIGNS

Figure 1:
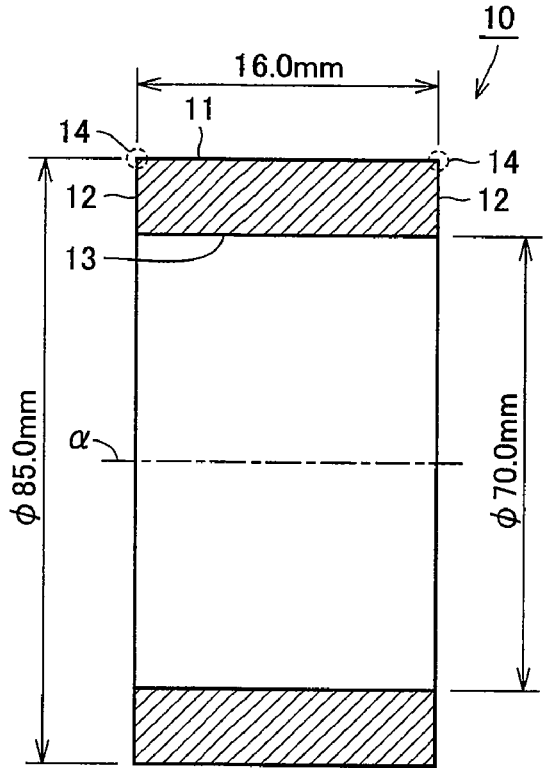
FIG. 1 is a schematic cross-sectional view of a bearing ring serving as an annular member in a first embodiment.

10 bearing ring; 11 outer circumferential surface; 12 end surface; 12A large-thickness side end surface; 12B small-thickness side end surface; 12C one end surface; 12D the other end surface; 13 inner circumferential surface; 14 ridgeline portion; 14A large-thickness side ridgeline portion; 14B small-thickness side ridgeline portion; 14C ridgeline portion on one side; 20 restrained cooling apparatus; 30 restraint member; 31 upper restraint member; 31A restraint surface; 31B bottom surface; 32 lower restraint member; 32A restraint surface; 32B bottom surface; 33 support base; 33A support surface; 34 load transfer member; and 34A flat surface.

BEST MODES FOR CARRYING OUT THE INVENTION

An embodiment of the present invention will be described hereinafter with reference to the drawings. In the drawings below, the same or corresponding elements have the same reference characters allotted, and detailed description thereof will not be repeated.

First Embodiment

A method of restrained-quenching of an annular member in a first embodiment will be described with reference to FIGS. 1 to 3.

Referring to FIG. 1, a bearing ring 10 has a cylindrical shape, and includes an outer circumferential surface 11, an inner circumferential surface 13 in parallel to outer circumferential surface 11 in a cross-section including an axis $\alpha$ of bearing ring 10, and two end surfaces 12, 12 intersecting with (orthogonal to) outer circumferential surface 11 and inner circumferential surface 13. In addition, ridgeline portions 14, 14 are formed at portions where two end surfaces 12, 12 intersect with outer circumferential surface 11, respectively. Ridgeline portion 14 is a beveled portion which is, for example, a beveled region. A method of restrained-quenching of an annular member in the first embodiment that is performed on bearing ring 10 will be described hereinafter.

Figure 2:
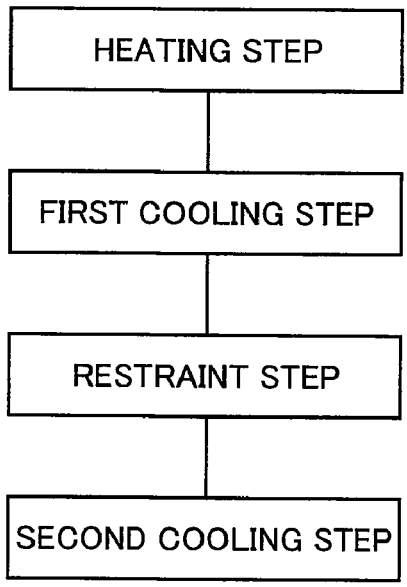
FIG. 2 is a flowchart showing outlines of a method of restrained-quenching of the annular member in the first embodiment.

Referring to FIG. 2, the method of restrained-quenching of the annular member in the first embodiment includes a heating step, a first cooling step, a restraint step, and a second cooling step. In the heating step, bearing ring 10 serving as the annular member made of steel such as a bearing steel (for example, SUJ2 under JIS) is heated to a temperature not lower than the $A_1$ point, in a range not lower than 800° C. and not higher than 1000° C., such as 850° C. In the first cooling step, bearing ring 10 heated in the heating step is cooled from the temperature not lower than the $A_1$ point to a first cooling temperature which is a temperature not higher than the $M_S$ point, in a range not lower than 150° C. and not higher than 250° C., such as 230° C.

Figure 3:
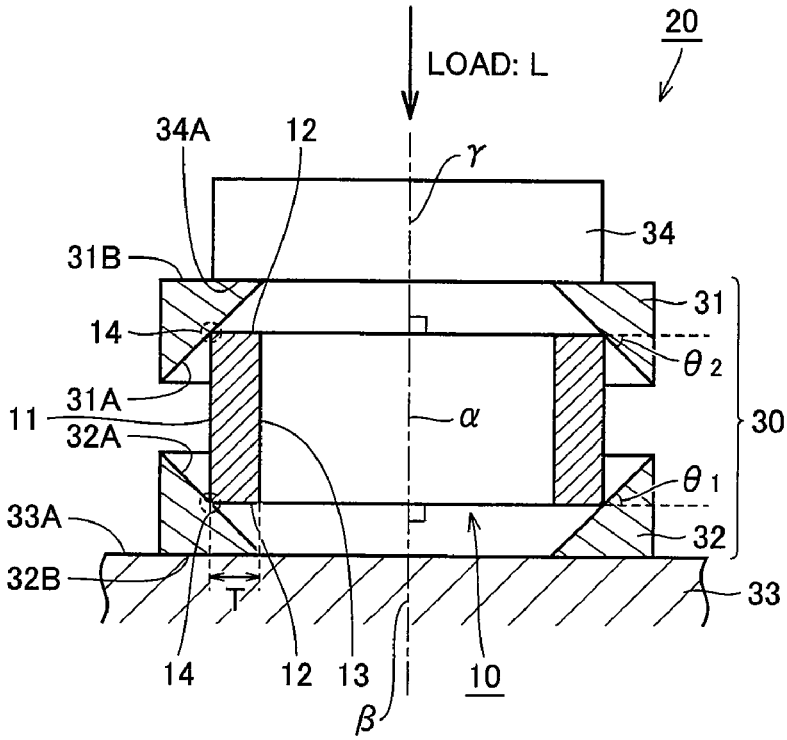
FIG. 3 is a schematic cross-sectional view for illustrating a restraint step and a second cooling step in the method of restrained-quenching of the annular member in the first embodiment.

In addition, referring to FIGS. 2 and 3, in the restraint step, bearing ring 10 cooled to the first cooling temperature is restrained with restraint member 30. In the second cooling step, bearing ring 10 restrained with restraint member 30 is cooled to a second cooling temperature which is a temperature in a range not lower than 30° C. and not higher than 100° C., such as 80° C., and lower than the restraint start temperature, while bearing ring 10 remains restrained with restraint member 30, the restraint start temperature being a temperature at which restraint with restraint member 30 is started and not higher than the $M_S$ point.

Here, a normal quench hardening treatment in which heating is performed in air and thereafter cooling is performed may be adopted, or a quench hardening treatment in which heating is performed in a controlled atmosphere and thereafter cooling is performed, such as bright heat treatment and carbonitriding treatment, may be adopted, as the quench hardening treatment performed by heating and cooling.

In the restraint step and the second cooling step, referring to FIG. 3, bearing ring 10 is restrained such that restraint member 30 and bearing ring 10 are in contact with each other at ridgeline portions 14 which are portions where outer circumferential surface 11 and two end surfaces 12, 12 of bearing ring 10 intersect with each other, without bearing ring 10 and restraint member 30 being in contact with each other at outer circumferential surface 11 and two end surfaces 12, 12 of bearing ring 10.

More specifically, in the restraint step, bearing ring 10 cooled to the first cooling temperature is restrained by using a restrained cooling apparatus 20, and in the second cooling step, bearing ring 10 restrained in the restraint step is cooled to the second cooling temperature while the restrained state is held. Here, restrained cooling apparatus 20 in the first embodiment includes a support base 33, a lower restraint member 32 arranged on support base 33, an upper restraint member 31 arranged above lower restraint member 32, and a load transfer member 34 arranged on upper restraint member 31. Lower restraint member 32 and upper restraint member 31 form restraint member 30.

A support surface 33A which is a flat surface is formed on support base 33. A restraint surface 32A having a conical surface shape is formed in lower restraint member 32. Restraint surface 32A is shaped to form a part of a side surface of a right circular cone. Then, lower restraint member 32 is arranged to be in contact with support surface 33A of support base 33 at a bottom surface 32B which is a flat surface. In addition, lower restraint member 32 is arranged such that a circle formed by intersection of restraint surface 32A and a plane perpendicular to an axis β which is an axis from the vertex of the right circular cone including restraint surface 32A to the center of the bottom face extends in parallel to support surface 33A. In addition, lower restraint member 32 is arranged on support base 33 such that the vertex of the right circular cone including restraint surface 32A is located on the side of support base 33 when viewed from restraint surface 32A. In other words, lower restraint member 32 is arranged on support base 33 such that a diameter of the circle formed by intersection of the plane perpendicular to axis β and restraint surface 32A becomes smaller toward support base 33.

On the other hand, upper restraint member 31 has a restraint surface 31A having a conical surface shape formed as in lower restraint member 32, and upper restraint member 31 basically has a structure the same as lower restraint member 32. Then, upper restraint member 31 is arranged such that restraint surface 31A of upper restraint member 31 and restraint surface 32A of lower restraint member 32 are opposed to each other. In addition, upper restraint member 31 is arranged such that a circle formed by intersection of restraint surface 31A and a plane perpendicular to an axis γ which is an axis from the vertex of a right circular cone including restraint surface 31A to the center of the bottom face extends in parallel to support surface 33A. Moreover, upper restraint member 31 is arranged such that the vertex of the right circular cone including restraint surface 31A is located on the side opposite to support base 33 when viewed from restraint surface 31A. In other words, upper restraint member 31 is arranged above lower restraint member 32 such that a diameter of the circle formed by intersection of the plane perpendicular to axis γ and restraint surface 31A becomes greater toward support base 33. Further, upper restraint member 31 and lower restraint member 32 are arranged such that axis β of lower restraint member 32 and axis γ of upper restraint member 31 coincide with each other.

In addition, load transfer member 34 is arranged such that a flat surface 34A which is a flat surface extends in parallel to support surface 33A and it comes in contact with a bottom surface 31B which is a flat surface of upper restraint member 31.

A procedure for restraining bearing ring 10 by using restrained cooling apparatus 20 in the restraint step will now be described. Initially, bearing ring 10 is set in contact with restraint surface 32A of lower restraint member 32 such that axis α of bearing ring 10 cooled to the first cooling temperature coincides with axis β of lower restraint member 32 arranged on support base 33. Here, since restraint surface 32A forms a part of the side face of the right circular cone as described previously, bearing ring 10 comes in contact with restraint surface 32A of lower restraint member 32 at ridgeline portion 14 but not in contact with lower restraint member 32 at outer circumferential surface 11, inner circumferential surface 13 and end surface 12.

Thereafter, upper restraint member 31 moves such that distance from lower restraint member 32 is decreased while axis γ of upper restraint member 31 remains coinciding with axis α of bearing ring 10 and axis β of lower restraint member 32, and comes in contact with bearing ring 10. Here, since restraint surface 31A also forms a part of the side face of the right circular cone as described previously, bearing ring 10 comes in contact with restraint surface 31A of upper restraint member 31 at ridgeline portion 14 but not in contact with upper restraint member 31 at outer circumferential surface 11, inner circumferential surface 13 and end surface 12. Then, load transfer member 34 is arranged on upper restraint member 31 so as to be in contact with bottom surface 31B, and desired load L is applied to load transfer member 34 by a load application apparatus such as a not-shown weight for press and an oil hydraulic cylinder. Bearing ring 10 is thus restrained at ridgeline portions 14.

Then, in the second cooling step, bearing ring 10 restrained in the restraint step as described above is cooled to the second cooling temperature while the restrained state is held. Here, bearing ring 10 may be cooled by being left in air while it is restrained as described above (unforced cooling) or it may be cooled by being blown with a gas such as air from a blower apparatus such as a blower (air blast cooling). Alternatively, in order to improve efficiency of the quench hardening treatment, bearing ring 10 may be cooled by being immersed in oil or being blown with oil (oil cooling), or it may be cooled by being immersed in water or being blown with water (water cooling).

As described above, in the restraint step and the second cooling step in the first embodiment, bearing ring 10 is restrained such that restraint member 30 and bearing ring 10 serving as the annular member are in contact with each other at ridgeline portions 14, and thus sufficient dimension accuracy and circularity can be obtained. Here, according to the restraint step in the first embodiment, by restraining bearing ring 10 such that axis α, axis β and axis γ coincide with one another, bearing ring 10 can be restrained at ridgeline portions 14 without accurately expecting in advance the dimension of bearing ring 10 at the restraint start time point. Therefore, a sufficient effect of restraint can readily be ensured.

In addition, as a result of restraint of bearing ring 10 at ridgeline portions 14 as described above, it is not necessary to prepare restraint member 30 having a shape of restraint surfaces 31A, 32A in conformity with bearing ring 10 for each dimension thereof, and one restraint member 30 can be used for restraining bearing rings 10 of various dimensions. Moreover, in the actual production line as well, it is not necessary to replace restraint member 30 to be used each time the dimension of bearing ring 10 to be quenched is changed, and efficiency of quenching treatment is improved. Therefore, treatment efficiency of the quench hardening treatment can be enhanced and production cost of bearing ring 10 can be suppressed.

As described above, according to the method of restrained-quenching of the annular member in the first embodiment, a sufficient effect of restraint can be ensured, treatment efficiency of the quench hardening treatment can be enhanced, and the production cost of bearing ring 10 serving as the annular member can be suppressed readily.

In addition, in the method of restrained-quenching of the annular member in the first embodiment, preferably, the restraint start temperature is not lower than 150° C. Thus, a ratio of austenite that transforms to martensite after restraint is started is sufficiently ensured, and heat treatment deformation or poor circularity of bearing ring 10 are further suppressed.

Moreover, in the method of restrained-quenching of the annular member in the first embodiment, preferably, the second cooling temperature is not higher than 100° C. Thus, the ratio of austenite that transforms to martensite after the second cooling step can sufficiently be suppressed and heat treatment deformation and poor circularity of bearing ring 10 can further be suppressed.

Further, in the method of restrained-quenching of the annular member in the first embodiment, preferably, a cooling rate in the second cooling step is not higher than 6° C./second. Thus, heat treatment deformation and poor circularity of bearing ring 10 can further be suppressed.

In addition, in the method of restrained-quenching of bearing ring 10 in the first embodiment, in the restraint step and the second cooling step, preferably, bearing ring 10 is restrained with restraint member 30 having a restraint member taper angle (a lower restraint member taper angle $\theta_1$ and an upper restraint member taper angle $\theta_2$) not smaller than 44.5 degrees and not greater than 45.5 degrees, under load not lower than load L satisfying relation of $$L=3.175\times(C_2/C_1)^{-1.754}\times S \quad (1).$$

Thus, circularity of bearing ring 10 can be improved to desired circularity $C_2$.

In addition, a method of manufacturing the annular member can be provided by adopting the method of restrained-quenching of the annular member in the first embodiment of the present invention above. A method of manufacturing the annular member in the first embodiment will be described with reference to FIG. 4.

Figure 4:
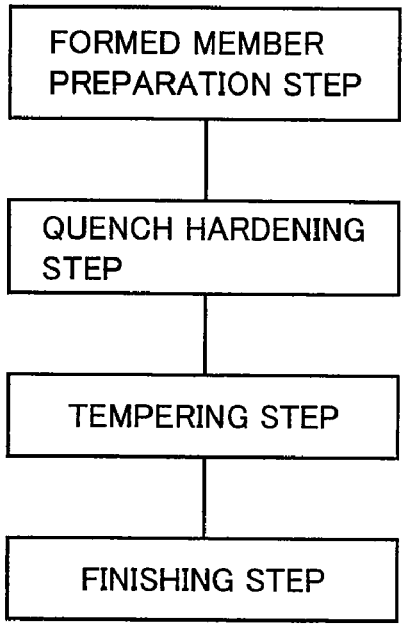
FIG. 4 is a flowchart showing outlines of a method of manufacturing the annular member in the first embodiment.

Referring to FIG. 4, the method of manufacturing the annular member in the first embodiment includes a formed member preparation step, a quench hardening step, a tempering step, and a finishing step. In the formed member preparation step, a formed member which is a member made of steel and roughly formed to a shape of bearing ring 10 to serve as the annular member is prepared. Specifically, the formed member is fabricated, for example, by working a steel material made of SUJ2 under JIS with forging, cutting or the like. In the quench hardening step, the formed member prepared in the formed member preparation step is quench-hardened. In the tempering step, the formed member quench-hardened in the quench hardening step is heated to a temperature lower than the $A_1$ point, in a range not lower than 150° C. and not higher than 300° C., such as 180° C., held for a period not shorter than 30 minutes and not longer than 240 minutes, such as 120 minutes, and thereafter left cooled in air at room temperature (air cooling). In the finishing step, the formed member tempered in the tempering step is finished. Specifically, the formed member is subjected to finishing such as grinding, superfinishing or the like, and bearing ring 10 serving as the annular member is completed.

The quenching treatment in the quench hardening step above is performed by using the method of restrained-quenching of the annular member in the first embodiment of the present invention. As described above, by adopting the method of restrained-quenching of the annular member in the first embodiment that can readily ensure a sufficient effect of restraint and enhance treatment efficiency of the quench hardening treatment in the quench hardening step, according to the method of manufacturing the annular member in the first embodiment of the present invention, heat treatment deformation and poor circularity are suppressed in a stable manner and production cost is suppressed.

Second Embodiment

A method of restrained-quenching of an annular member in a second embodiment will now be described with reference to FIGS. 5 and 6.

Figure 5:
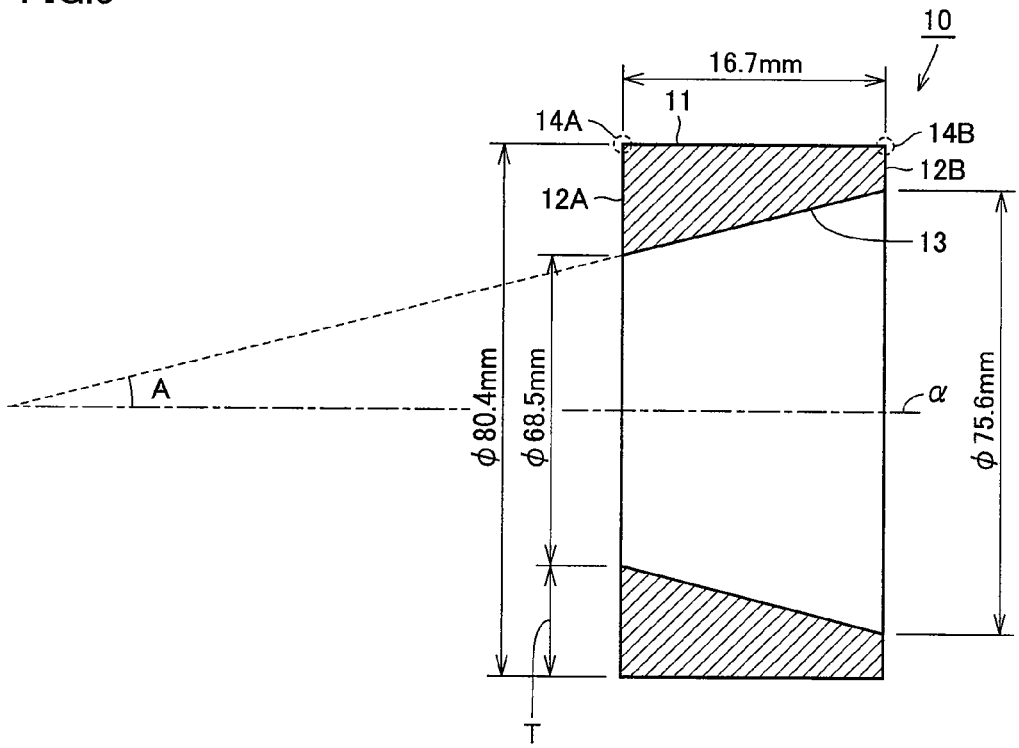
FIG. 5 is a schematic cross-sectional view of a bearing ring serving as an annular member in a second embodiment.

Referring to FIG. 5, bearing ring 10 serving as the annular member in the second embodiment has a structure basically the same as bearing ring 10 in the first embodiment. Bearing ring 10 in the second embodiment, however, is different from bearing ring 10 in the first embodiment in that outer circumferential surface 11 and inner circumferential surface 13 are not in parallel to each other in a cross-section including axis α and that bearing ring 10 has a tapered shape at a bearing ring taper angle A defined as a taper angle of the annular member. In addition, bearing ring 10 has a large-thickness side end surface 12A having a greater thickness in a radial direction and a small-thickness side end surface 12B having a thickness in the radial direction smaller than large-thickness side end surface 12A. The method of restrained-quenching of the annular member in the second embodiment performed on bearing ring 10 will be described hereinafter. It is noted that the taper angle of the annular member refers to an angle between a line of extension of the inner circumferential surface and an axis, in the cross-section including the axis of the annular member.

Figure 6:
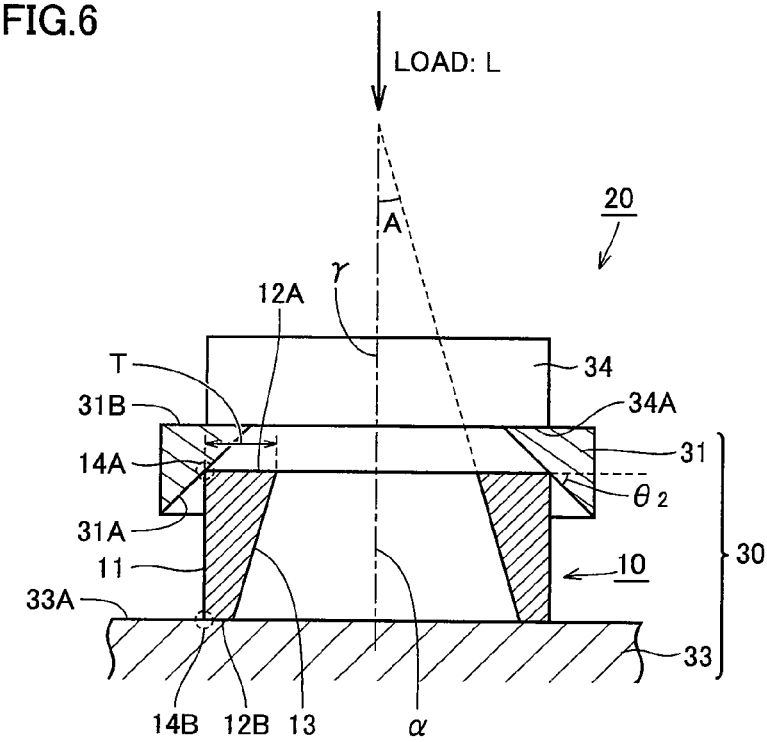
FIG. 6 is a schematic cross-sectional view for illustrating a restraint step and a second cooling step in the method of restrained-quenching of the annular member in the second embodiment.

Referring to FIG. 6, the method of restrained-quenching of the annular member in the second embodiment is basically performed similarly to the method of restrained-quenching of the annular member in the first embodiment. On the other hand, the method of restrained-quenching of the annular member in the second embodiment is different from the method of restrained-quenching of the annular member in the first embodiment, because of difference in the shape of bearing ring 10 serving as the annular member and the structure of restraint member 30.

Specifically, referring to FIG. 6, restrained cooling apparatus 20 in the second embodiment does not include lower restraint member 32 in the first embodiment, but support base 33 serves as lower restraint member 32 in the first embodiment. Namely, in restrained cooling apparatus 20 in the second embodiment, upper restraint member 31 and support base 33 form restraint member 30.

A procedure for restraining bearing ring 10 by using restrained cooling apparatus 20 in the second embodiment will now be described. Initially, bearing ring 10 cooled to the first cooling temperature is set on support base 33 such that bearing ring 10 is in contact with support surface 33A of support base 33 at small-thickness side end surface 12B. Namely, bearing ring 10 is in contact with restraint member 30 at small-thickness side end surface 12B which is one end surface.

Thereafter, upper restraint member 31 moves such that distance from support base 33 is decreased while axis γ of upper restraint member 31 remains coinciding with axis α of bearing ring 10, and comes in contact with bearing ring 10. Here, since restraint surface 31A forms a part of the side face of the right circular cone as in the first embodiment, bearing ring 10 comes in contact with restraint surface 31A of upper restraint member 31 at a large-thickness side ridgeline portion 14A adjacent to large-thickness side end surface 12A but not in contact with upper restraint member 31 at outer circumferential surface 11, inner circumferential surface 13 and large-thickness side end surface 12A. Then, load transfer member 34 is arranged on upper restraint member 31 so as to be in contact with bottom surface 31B, and desired load L is applied to load transfer member 34 by a load application apparatus such as a not-shown weight for press and an oil hydraulic cylinder. Bearing ring 10 is thus restrained at large-thickness side ridgeline portion 14A adjacent to large-thickness side end surface 12A and small-thickness side end surface 12B.

Then, in the second cooling step, similarly to the first embodiment, bearing ring 10 restrained in the restraint step is cooled to the second cooling temperature while the restrained state is held. Here, bearing ring 10 in the second embodiment has such a tapered shape that a thickness in the radial direction is different in a direction of axis α. Then, in the restraint step and the second cooling step, assuming that large-thickness side end surface 12A which is an end surface of bearing ring 10 greater in thickness is defined as one end surface and small-thickness side end surface 12B which is an end surface smaller in thickness is defined as the other end surface, bearing ring 10 is restrained at large-thickness side ridgeline portion 14A which is a portion where one end surface and outer circumferential surface 11 intersect with each other and at the other end surface.

As described above, in the method of restrained-quenching of the annular member in the second embodiment, bearing ring 10 serving as the annular member is restrained at large-thickness side ridgeline portion 14A defined as one ridgeline portion. Here, the annular member does not necessarily have to be restrained at ridgeline portions adjacent to end surfaces on opposing sides, but sufficient dimension accuracy and circularity can be obtained if the annular member is restrained only on one side. In addition, in the case where the annular member is restrained at the ridgeline portion only on one side and the restrained annular member has the tapered shape, when the ridgeline portion adjacent to the end surface of the annular member on the side greater in thickness in the radial direction (the ridgeline portion adjacent to the end surface of the annular member on the side closer to a portion greater in thickness in the radial direction) is restrained, dimension accuracy and circularity superior to a case where the ridgeline portion adjacent to the end surface on the side smaller in thickness in the radial direction is restrained can be obtained.

Therefore, according to the method of restrained-quenching of the annular member in the second embodiment, bearing ring 10 is restrained at large-thickness side ridgeline portion 14A defined as one ridgeline portion, so that dimension accuracy and circularity comparable to a case where bearing ring 10 is restrained at both ridgeline portions 14A, 14B can be obtained. In addition, by restraining bearing ring 10 such that axis α and axis γ coincide with each other, bearing ring 10 can be restrained at large-thickness side ridgeline portion 14A without accurately expecting in advance the dimension of bearing ring 10 at the restraint start time point. Therefore, a sufficient effect of restraint can readily be ensured.

In addition, as a result of restraint of large-thickness side ridgeline portion 14A by restraint surface 31A of upper restraint member 31 and restraint of small-thickness side end surface 12B by support surface 33A of support base 33, it is not necessary to prepare restraint member 30 in conformity with bearing ring 10 for each dimension thereof, and one restraint member 30 can be used for restraining bearing rings 10 of various dimensions. Moreover, in the actual production line as well, it is not necessary to replace restraint member 30 to be used each time the dimension of bearing ring 10 to be quenched is changed, and efficiency of quenching treatment is improved. Therefore, treatment efficiency of the quench hardening treatment can be enhanced and production cost of bearing ring 10 can be suppressed.

In addition, according to the method of restrained-quenching of the annular member in the second embodiment, a component in restrained cooling apparatus 20 (lower restraint member 32) can be eliminated as compared with the first embodiment. Therefore, not only restrained cooling apparatus 20 can be simplified, but also interference between restraint members 30 is less likely even though a length of bearing ring 10 in the direction of axis α (height of bearing ring 10) is small, and bearing ring 10 in a wider dimension range can be restrained.

The quenching treatment in the quench-hardening step in the method of manufacturing the annular member in the first embodiment described in connection with FIG. 4 may be performed by using the method of restrained-quenching of the annular member in the second embodiment above. In addition, in the embodiment above, though an example where support base 33 is used as restraint member 30 is described, a flat-plate-shaped restraint member for directly restraining bearing ring 10 may be arranged on support base 33 such that bearing ring 10 comes in contact with restraint surface 33A of support base 33, in consideration of durability of support base 33.

Third Embodiment

A method of restrained-quenching of an annular member in a third embodiment will now be described with reference to FIGS. 1, 2 and 7.

Figure 7:
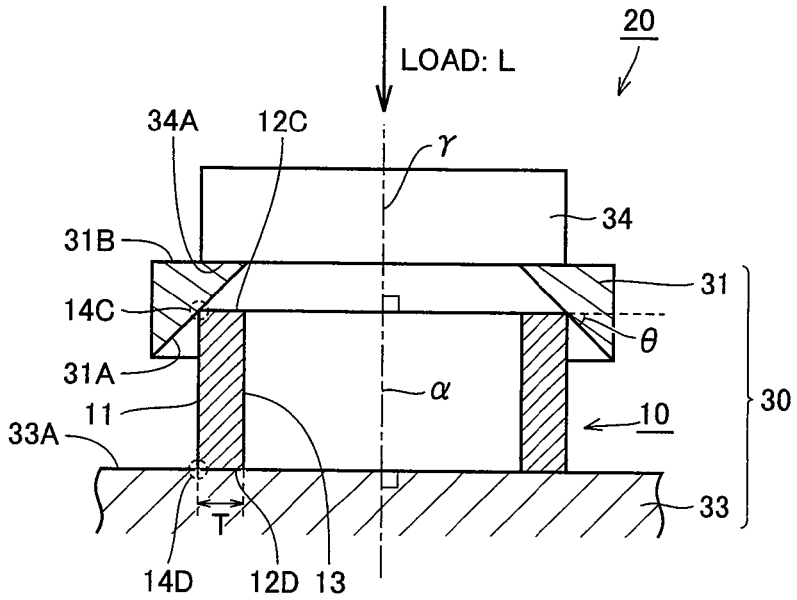
FIG. 7 is a schematic cross-sectional view for illustrating a restraint step and a second cooling step in a method of restrained-quenching of an annular member in a third embodiment.

Referring to FIGS. 1, 2 and 7, the method of restrained-quenching of the annular member in the third embodiment is basically performed similarly to the method of restrained-quenching of the annular member in the first embodiment. On the other hand, the method of restrained-quenching of the annular member in the third embodiment is different from the method of restrained-quenching of the annular member in the first embodiment, because of difference in the structure of restraint member 30.

Namely, in the restraint step and the second cooling step, referring to FIG. 7, bearing ring 10 is restrained such that restraint member 30 and bearing ring 10 are in contact with each other at a ridgeline portion 14C on one side which is a portion where outer circumferential surface 11 and one end surface 12C of bearing ring 10 intersect with each other and bearing ring 10 and restraint member 30 are in contact with each other at the other end surface 12D which is an end surface opposite to one end surface 12C, without bearing ring 10 and restraint member 30 being in contact with each other at outer circumferential surface 11 and one end surface 12C of bearing ring 10.

More specifically, in the restraint step, bearing ring 10 cooled to the first cooling temperature is restrained by using restrained cooling apparatus 20, and in the second cooling step, bearing ring 10 restrained in the restraint step is cooled to the second cooling temperature while the restrained state is held. Here, restrained cooling apparatus 20 in the third embodiment includes support base 33, upper restraint member 31 arranged above support base 33, and load transfer member 34 arranged on upper restraint member 31. Support base 33 and upper restraint member 31 form restraint member 30.

A restraint surface 33A which is a flat surface is formed on support base 33. Restraint surface 31A having a conical surface shape is formed in upper restraint member 31, and restraint surface 31A is shaped to form a part of a side face of a right circular cone. Then, upper restraint member 31 is arranged above support base 33 such that restraint surface 31A is opposed to restraint surface 33A of support base 33. In addition, upper restraint member 31 is arranged such that a circle formed by intersection of restraint surface 31A and a plane perpendicular to axis $\gamma$ which is an axis from the vertex of the right circular cone including restraint surface 31A to the center of the bottom face extends in parallel to restraint surface 33A of support base 33. In addition, upper restraint member 31 is arranged above support base 33 such that the vertex of the right circular cone including restraint surface 31A is located on the side opposite to support base 33 when viewed from restraint surface 31A. In other words, upper restraint member 31 is arranged above support base 33 such that a diameter of the circle formed by intersection of the plane perpendicular to axis $\gamma$ and restraint surface 31A becomes greater toward support base 33.

Further, load transfer member 34 is arranged such that flat surface 34A which is a flat surface extends in parallel to restraint surface 33A of support base 33 and it comes in contact with bottom surface 31B which is a flat surface of upper restraint member 31.

A procedure for restraining bearing ring 10 by using restrained cooling apparatus 20 in the restraint step will now be described. Initially, bearing ring 10 cooled to the first cooling temperature is set on support base 33 such that bearing ring 10 comes in contact with restraint surface 33A of support base 33 at the other end surface 12D. Namely, bearing ring 10 is in contact with restraint member 30 at the other end surface 12D.

Thereafter, upper restraint member 31 moves such that distance from support base 33 is decreased while axis $\gamma$ of upper restraint member 31 remains coinciding with axis $\alpha$ of bearing ring 10, and comes in contact with bearing ring 10. Here, since restraint surface 31A forms a part of the side face of the right circular cone as described above, bearing ring 10 comes in contact with restraint surface 31A of upper restraint member 31 at ridgeline portion 14C on one side adjacent to one end surface 12C but not in contact with upper restraint member 31 at outer circumferential surface 11, inner circumferential surface 13 and one end surface 12C. Then, load transfer member 34 is arranged on upper restraint member 31 so as to be in contact with bottom surface 31B, and desired load L is applied to load transfer member 34 by a load application apparatus such as a not-shown weight for press and an oil hydraulic cylinder. Bearing ring 10 is thus restrained at ridgeline portion 14C on one side adjacent to one end surface 12C and at the other end surface 12D.

Then, in the second cooling step, bearing ring 10 restrained in the restraint step as described above is cooled to the second cooling temperature while the restrained state is held. Here, bearing ring 10 may be cooled by being left in air while it is restrained as described above (unforced cooling) or it may be cooled by being blown with a gas such as air from a blower apparatus such as a blower (air blast cooling). Alternatively, in order to improve efficiency of the quench hardening treatment, bearing ring 10 may be cooled by being immersed in oil or being blown with oil (oil cooling), or it may be cooled by being immersed in water or being blown with water (water cooling).

As described above, in the restraint step and the second cooling step in the third embodiment, bearing ring 10 is restrained such that upper restraint member 31 defined as one restraint member and bearing ring 10 are in contact with each other at ridgeline portion 14C on one side and support base 33 serving as another restraint member and bearing ring 10 are in contact with each other at the other end surface 12D defined as an end surface on the other side, and thus sufficient dimension accuracy and circularity can be obtained. Here, according to the restraint step in the third embodiment, by restraining bearing ring 10 such that axis $\alpha$ and axis $\gamma$ coincide with each other, bearing ring 10 can be restrained at ridgeline portion 14C on one side and at the other end surface 12D without accurately expecting in advance the dimension of bearing ring 10 at the restraint start time point. Therefore, a sufficient effect of restraint can readily be ensured.

In addition, as a result of restraint of bearing ring 10 at ridgeline portion 14C on one side and at the other end surface 12D as described above, it is not necessary to prepare restraint member 30 having a shape of restraint surfaces 31A, 33A in conformity with bearing ring 10 for each dimension thereof, and one restraint member 30 can be used for restraining bearing rings 10 of various dimensions. Moreover, in the actual production line as well, it is not necessary to replace restraint member 30 to be used each time the dimension of bearing ring 10 to be quenched is changed, and efficiency of quenching treatment is improved. Therefore, treatment efficiency of the quench hardening treatment can be enhanced and production cost of bearing ring 10 can be suppressed.

As described above, according to the method of restrained-quenching of the annular member in the third embodiment, a sufficient effect of restraint can be ensured, treatment efficiency of the quench hardening treatment can be enhanced, and the production cost of bearing ring 10 serving as the annular member can be suppressed readily.

In addition, in the method of restrained-quenching of the annular member in the third embodiment, preferably, the restraint start temperature is not lower than 150° C. Thus, a ratio of austenite that transforms to martensite after restraint is started is sufficiently ensured, and heat treatment deformation and poor circularity of bearing ring 10 are further suppressed.

Moreover, in the method of restrained-quenching of the annular member in the third embodiment, preferably, the second cooling temperature is not higher than 100° C. Thus, the ratio of austenite that transforms to martensite after the second cooling step can sufficiently be suppressed and heat treatment deformation and poor circularity of bearing ring 10 can further be suppressed.

Further, in the method of restrained-quenching of the annular member in the third embodiment, preferably, a cooling rate in the second cooling step is not higher than 6° C./second. Thus, heat treatment deformation and poor circularity of bearing ring 10 can further be suppressed.

It is noted that a method of manufacturing the annular member can be provided by adopting the method of restrained-quenching of the annular member in the third embodiment of the present invention above, as in the first embodiment.

Fourth Embodiment

A method of restrained-quenching of an annular member in a fourth embodiment will now be described with reference to FIGS. 2, 5, and 8.

Figure 8:
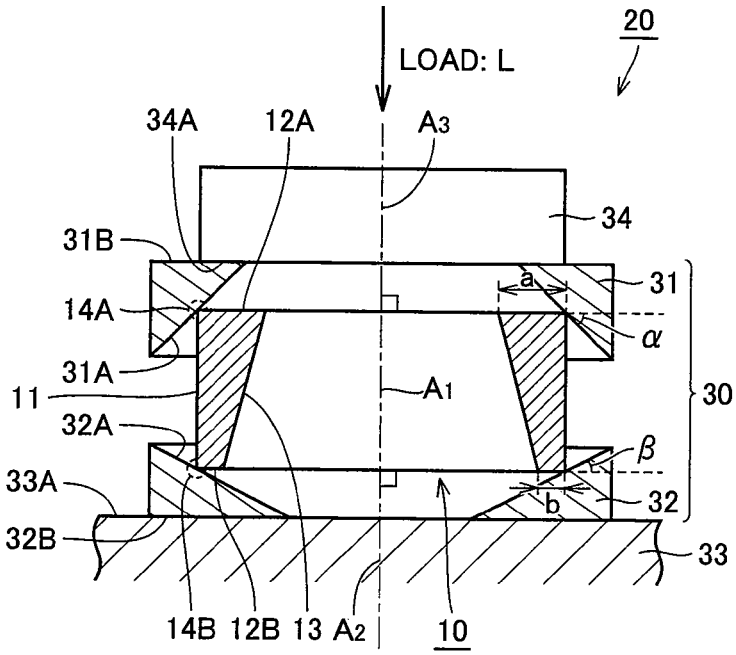
FIG. 8 is a schematic cross-sectional view for illustrating a restraint step and a second cooling step in a method of restrained-quenching of an annular member in a fourth embodiment.

Referring to FIGS. 2, 5 and 8, the method of restrained-quenching of the annular member in the fourth embodiment is basically performed similarly to the method of restrained-quenching of the annular member in the first embodiment. On the other hand, the method of restrained-quenching of the annular member in the fourth embodiment is different from the method of restrained-quenching of the annular member in the first embodiment, because of difference in the structure of bearing ring 10 and restraint member 30.

Specifically, in the restraint step and the second cooling step, referring to FIG. 8, restraint member 30 and bearing ring 10 are in contact with each other at large-thickness side ridgeline portion 14A and small-thickness side ridgeline portion 14B defined as two ridgeline portions which are portions where outer circumferential surface 11 and two end surfaces, that is, large-thickness side end surface 12A and small-thickness side end surface 12B, of bearing ring 10 intersect with each other, without bearing ring 10 and restraint member 30 being in contact with each other at outer circumferential surface 11 and two end surfaces, that is, large-thickness side end surface 12A and small-thickness side end surface 12B, of bearing ring 10.

In addition, bearing ring 10 is restrained such that, in the cross-section including an axis $A_1$ of bearing ring 10, an upper restraint member taper angle $\alpha$ and a lower restraint member taper angle $\beta$ defined as a restraint member taper angle representing an angle between a plane perpendicular to a direction of load L applied to restraint member 30 and respective tangents at portions where upper restraint member 31 and lower restraint member 32 forming restraint member 30 come in contact with bearing ring 10 and thicknesses a and b in the radial direction at large-thickness side end surface 12A and small-thickness side end surface 12B of bearing ring 10 satisfy relation shown in Equation (2).

Here, ideally, upper restraint member taper angle $\alpha$ and lower restraint member taper angle $\beta$ and thicknesses a and b in the radial direction at large-thickness side end surface 12A and small-thickness side end surface 12B of bearing ring 10 satisfy relation in Equation (3) below.

$$(b/a)=(\sin\beta/\sin\alpha) \quad (3)$$

So long as the relation in Equation (2) is satisfied, however, an effect to suppress an amount of leaning is almost comparable to a case where Equation (3) is satisfied, and the amount of leaning can be suppressed within a range allowable in practical use. If the amount of leaning should particularly be suppressed, upper restraint member taper angle $\alpha$ and lower restraint member taper angle $\beta$ and thicknesses a and b in the radial direction at large-thickness side end surface 12A and small-thickness side end surface 12B of bearing ring 10 preferably satisfy relation in Equation (4) below.

$$0.95\times(b/a)\leqq(\sin\beta/\sin\alpha)\leqq1.05\times(b/a) \quad (4)$$

More specifically, in the restraint step, bearing ring 10 cooled to the first cooling temperature is restrained by using restrained cooling apparatus 20, and in the second cooling step, bearing ring 10 restrained in the restraint step is cooled to the second cooling temperature while the restrained state is held. Here, referring to FIG. 8, restrained cooling apparatus 20 in the present embodiment includes support base 33, lower restraint member 32 arranged on support base 33, upper restraint member 31 arranged above lower restraint member 32, and load transfer member 34 arranged on upper restraint member 31. Lower restraint member 32 and upper restraint member 31 form restraint member 30.

Support surface 33A which is a flat surface is formed on support base 33. Restraint surface 32A having a conical surface shape is formed in lower restraint member 32. Restraint surface 32A is shaped to form a part of a side face of a right circular cone. Then, lower restraint member 32 is arranged to be in contact with support surface 33A of support base 33 at bottom surface 32B which is a flat surface. In addition, lower restraint member 32 is arranged such that a circle formed by intersection of restraint surface 32A and a plane perpendicular to an axis $A_2$ which is an axis from the vertex of the right circular cone including restraint surface 32A to the center of the bottom face extends in parallel to support surface 33A. In addition, lower restraint member 32 is arranged on support base 33 such that the vertex of the right circular cone including restraint surface 32A is located on the side of support base 33 when viewed from restraint surface 32A. In other words, lower restraint member 32 is arranged on support base 33 such that a diameter of the circle formed by intersection of the plane perpendicular to axis $A_2$ and restraint surface 32A becomes smaller toward support base 33.

On the other hand, upper restraint member 31 has restraint surface 31A having a conical surface shape formed as in lower restraint member 32 and has a structure basically the same as lower restraint member 32. Then, upper restraint member 31 is arranged such that restraint surface 31A of upper restraint member 31 and restraint surface 32A of lower restraint member 32 are opposed to each other. In addition, upper restraint member 31 is arranged such that a circle formed by intersection of restraint surface 31A and a plane perpendicular to an axis $A_3$ which is an axis from the vertex of a right circular cone including restraint surface 31A to the center of the bottom face extends in parallel to support surface 33A. Moreover, upper restraint member 31 is arranged such that the vertex of the right circular cone including restraint surface 31A is located on the side opposite to support base 33 when viewed from restraint surface 31A. In other words, upper restraint member 31 is arranged above lower restraint member 32 such that a diameter of the circle formed by intersection of the plane perpendicular to axis $A_3$ and restraint surface 31A becomes greater toward support base 33. In addition, upper restraint member 31 and lower restraint member 32 are arranged such that axis $A_2$ of lower restraint member 32 and axis $A_3$ of upper restraint member 31 coincide with each other.

Here, such upper restraint member 31 and lower restraint member 32 that upper restraint member taper angle $\alpha$ and lower restraint member taper angle $\beta$ and thicknesses a and b in the radial direction at large-thickness side end surface 12A and small-thickness side end surface 12B of bearing ring 10 satisfy relation shown in Equation (2) are adopted as restraint member 30.

Further, load transfer member 34 is arranged such that flat surface 34A which is a flat surface extends in parallel to support surface 33A and it comes in contact with bottom surface 31B which is a flat surface of upper restraint member 31.

A procedure for restraining bearing ring 10 by using restrained cooling apparatus 20 in the restraint step will now be described. Initially, bearing ring 10 cooled to the first cooling temperature is set such that bearing ring 10 is in contact with restraint surface 32A of lower restraint member 32 at small-thickness side ridgeline portion 14B and axis $A_1$ of bearing ring 10 coincides with axis $A_2$ of lower restraint member 32 arranged on support base 33.

Thereafter, upper restraint member 31 moves such that distance from lower restraint member 32 is decreased while axis $A_3$ of upper restraint member 31 remains coinciding with axis $A_1$ of bearing ring 10 and axis $A_2$ of lower restraint member 32, and comes in contact with bearing ring 10. Then, load transfer member 34 is arranged on upper restraint member 31 so as to be in contact with bottom surface 31B, and desired load L is applied to load transfer member 34 by a load application apparatus such as a not-shown weight for press and an oil hydraulic cylinder. Bearing ring 10 is thus restrained at ridgeline portions 14A, 14B.

Here, since restraint surfaces 31A, 32A of restraint member 30 form a part of the side face of the right circular cone as described previously, bearing ring 10 comes in contact with restraint surfaces 31A and 32A of upper restraint member 31 and lower restraint member 32 at two ridgeline portions 14A, 14B respectively but not in contact with upper restraint member 31 and lower restraint member 32 at outer circumferential surface 11, inner circumferential surface 13 and two end surfaces 12A, 12B. In addition, since such upper restraint member 31 and lower restraint member 32 that upper restraint member taper angle $\alpha$ and lower restraint member taper angle $\beta$ and thicknesses a and b in the radial direction at large-thickness side end surface 12A and small-thickness side end surface 12B of bearing ring 10 satisfy relation shown in Equation (2) are adopted as restraint member 30 as described previously, bearing ring 10 is restrained at ridgeline portions 14A, 14B so as to satisfy the relation shown in Equation (2).

Then, in the second cooling step, bearing ring 10 restrained in the restraint step as described above is cooled to the second cooling temperature while the restrained state is held. Here, bearing ring 10 may be cooled by being left in air while it is restrained as described above (unforced cooling) or it may be cooled by being blown with a gas such as air from a blower apparatus such as a blower (air blast cooling). Alternatively, in order to improve efficiency of the quench hardening treatment, bearing ring 10 may be cooled by being immersed in oil or being blown with oil (oil cooling), or it may be cooled by being immersed in water or being blown with water (water cooling).

By performing the restraint step and the second cooling step as described above, bearing ring 10 can be restrained at two ridgeline portions 14A and 14B without accurately expecting in advance the dimension of bearing ring 10 at the restraint start time point. In addition, by performing the restraint step and the second cooling step as described above, sufficient circularity can be obtained and leaning deformation can be suppressed. Consequently, according to the method of restrained-quenching of the annular member in the present embodiment, a sufficient effect of restraint can be ensured, treatment efficiency of the quench hardening treatment can be enhanced, and the production cost of bearing ring 10 serving as the annular member can be suppressed readily.

In addition, in the method of restrained-quenching of the annular member in the embodiment above, preferably, the restraint start temperature is not lower than 150° C. Thus, a ratio of austenite that transforms to martensite after restraint is started is sufficiently ensured, and poor circularity and leaning deformation of bearing ring 10 are further suppressed.

Moreover, in the method of restrained-quenching of the annular member in the embodiment above, preferably, the second cooling temperature is not higher than 100° C. Thus, the ratio of austenite that transforms to martensite after the second cooling step can sufficiently be suppressed and poor circularity and leaning deformation of bearing ring 10 can further be suppressed.

Further, in the method of restrained-quenching of the annular member in the embodiment above, preferably, a cooling rate in the second cooling step is not higher than 6° C./second. Thus, poor circularity and leaning deformation of bearing ring 10 can further be suppressed.

It is noted that a method of manufacturing the annular member can be provided by adopting the method of restrained-quenching of the annular member in the fourth embodiment of the present invention above, as in the first embodiment.

Example 1

An Example 1 of the present invention will be described hereinafter. Tests for examining influence on circularity of the annular member, of (1) whether restraint is applied or not, (2) a restraint start temperature, (3) a restraint end temperature (second cooling temperature), (4) a cooling rate in the second cooling step, (5) a shape of the annular member, (6) a taper angle of the lower restraint member, and (7) restraint load were conducted.

Initially, a test method will be described. A steel material JIS SUJ2 included in high-carbon chromium bearing steel was formed by turning or the like, to fabricate two types of annular members, that is, an annular member in a cylindrical shape (not tapered) having an outer diameter $\phi$ 85.0 mm and an inner diameter $\phi$ 70.0 mm (FIG. 1) and an annular member in a tapered shape having an outer diameter $\phi$ 80.4 mm, a large-thickness side inner diameter $\phi$ 68.5 mm and a small-thickness side inner diameter $\phi$ 75.6 mm (FIG. 5). Then, the annular member was placed in a heating furnace adjusted to a reducing atmosphere for preventing decarburization, and held at 810° C. for 40 minutes.

Thereafter, the annular member was taken out of the heating furnace, immediately (within one second) immersed in a quenching oil adjusted to 80° C. (cold type, high speed quench oil No. 1070S manufactured by Nippon Grease Co., Ltd.), and cooled to the first cooling temperature which is a temperature not higher than the $M_S$ point. Then, the annular member was taken out of the quenching oil and restrained by using restrained cooling apparatus 20 in the first embodiment described in connection with FIG. 3. Here, the annular member in the tapered shape was restrained such that the ridgeline portion adjacent to the small-thickness side end surface was in contact with lower restraint member 32. In addition, a temperature of the annular member at the time point when restraint was started (restraint start temperature) was measured. The restraint start temperature attained to a temperature not higher than the $M_S$ point and lower than the first cooling temperature.

In addition, the restrained annular member was cooled to the second cooling temperature lower than the restraint start temperature and thereafter taken out of the restrained cooling apparatus. Annular members varied in the restraint start temperature, the restraint end temperature (second cooling temperature), the cooling rate in the second cooling step, the shape of the annular member, the taper angle of the lower restraint member, and the restraint load in the procedure described above were fabricated and employed as samples.

Then, circularity of the samples fabricated as described above was measured based on the least squares circle (LSC) method defined under JIS B7451, by using a circularity measurement apparatus. It is noted that a smaller value of circularity indicates being closer to a perfect circle and superiority.

In addition, in order to check an effect of restraint, a sample not restrained by using the restrained cooling apparatus in the procedure described above was also fabricated and circularity thereof was measured.

Test results will now be described. Table 1 shows conditions for the test and results of measurement of circularity. Here, considering an actual mass production process, less variation of circularity is also important. Therefore, standard deviation was also calculated together with an average value of measured circularity and shown in Table 1.

TABLE 1

| | Object of Test | | | | | | | | | |
|---|---|---|---|---|---|---|---|---|---|---|
| | Influence of Restraint | | Influence of Load | | | Influence of Restraint Member Taper Angle | | | | |
| Sample No. | 1 | 2 | 3 | 4 | 5 | 6 | 7 | 8 | 9 | 10 |
| Load (kgf) | — | — | 1 | 20 | 40 | 40 | 40 | 40 | 40 | 40 |
| Upper Restraint Member Taper Angle (degree) | — | — | 45 | 45 | 45 | 65 | 45 | 45 | 45 | 45 |
| Lower Restraint Member Taper Angle (degree) | — | — | 45 | 45 | 45 | 55 | 34 | 22.5 | 17 | 0 |
| Restraint Start Temperature (° C.) | — | — | 250 | 250 | 250 | 250 | 250 | 250 | 250 | 250 |
| Second Cooling Temperature (° C.) | — | — | 30 | 30 | 30 | 30 | 30 | 30 | 30 | 30 |
| Cooling Rate (° C./Second) | — | — | 1.5 | 1.5 | 1.5 | 1.5 | 1.5 | 1.5 | 1.5 | 1.5 |
| Shape of Annular Member | FIG. 5 | FIG. 1 | FIG. 5 | FIG. 5 | FIG. 5 | FIG. 5 | FIG. 5 | FIG. 5 | FIG. 5 | FIG. 5 |
| Number of Tests | 40 | 10 | 10 | 20 | 20 | 10 | 10 | 10 | 20 | 20 |
| Average Value of Circularity (μm) | 150 | 150 | 130 | 60 | 50 | 40 | 50 | 40 | 40 | 40 |
| Standard Deviation of Circularity (μm) | 50 | 70 | 30 | 10 | 10 | 10 | 20 | 10 | 10 | 10 |

| | Object of Test | | | | | | | | |
|---|---|---|---|---|---|---|---|---|---|
| | Influence of Restraint Start Temperature | | Influence of Second Cooling Temperature | | | Influence of Cooling Rate | | | Influence of Shape of Annular Member |
| Sample No. | 11 | 12 | 13 | 14 | 15 | 16 | 17 | 18 | 19 |
| Load (kgf) | 20 | 20 | 20 | 20 | 20 | 20 | 20 | 20 | 40 |
| Upper Restraint Member Taper Angle (degree) | 45 | 45 | 45 | 45 | 45 | 45 | 45 | 45 | 45 |
| Lower Restraint Member Taper Angle (degree) | 45 | 45 | 45 | 45 | 45 | 45 | 45 | 45 | 45 |
| Restraint Start Temperature (° C.) | 150 | 100 | 250 | 250 | 250 | 250 | 220 | 250 | 250 |
| Second Cooling Temperature (° C.) | 30 | 30 | 80 | 100 | 150 | 30 | 80 | 30 | 30 |
| Cooling Rate (° C./Second) | 1.5 | 1.5 | 1.5 | 3.0 | 1.5 | 3.0 | 6.0 | 20.0 | 1.5 |
| Shape of Annular Member | FIG. 5 | FIG. 5 | FIG. 5 | FIG. 5 | FIG. 5 | FIG. 5 | FIG. 5 | FIG. 5 | FIG. 1 |
| Number of Tests | 10 | 10 | 10 | 10 | 10 | 10 | 10 | 10 | 10 |
| Average Value of Circularity (μm) | 60 | 140 | 60 | 60 | 90 | 60 | 50 | 100 | 50 |
| Standard Deviation of Circularity (μm) | 20 | 50 | 10 | 30 | 20 | 10 | 30 | 30 | 20 |

(1) Whether Restraint was Applied or Not

Initially, influence of whether restraint at the ridgeline portion was applied or not will be described. Referring to Table 1, comparing sample numbers 1 and 2 for which restraint was not applied with sample numbers 3 to 19 for which restraint at the ridgeline portion was applied as described above, sample numbers 3 to 19 for which restraint at the ridgeline portion was applied were smaller in the average value and the standard deviation of circularity than sample numbers 1 and 2. It was thus confirmed that circularity can be improved by restraining the annular member at the ridgeline portion.

(2) Restraint Start Temperature

Figure 9:
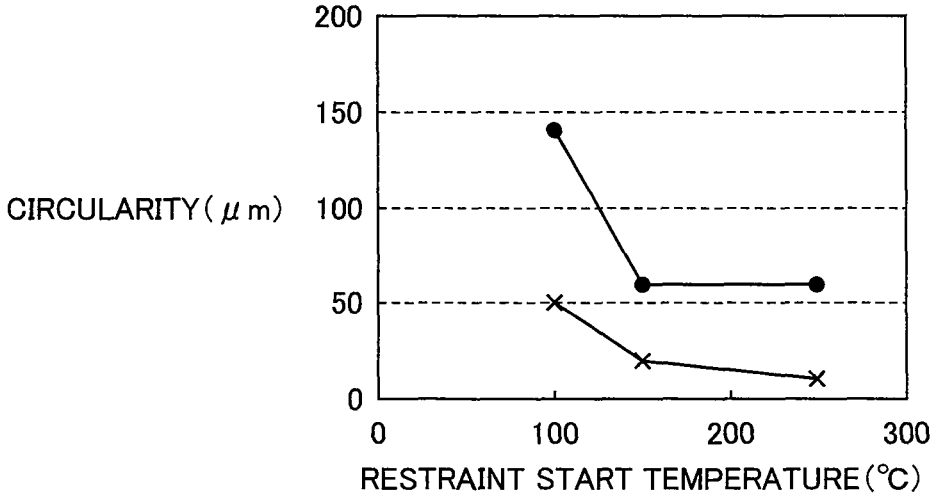
FIG. 9 is a diagram showing relation between a restraint start temperature and circularity.

Referring next to FIG. 9, influence of the restraint start temperature will be described. In FIG. 9, the abscissa represents the restraint start temperature, the ordinate represents circularity, a circle represents the average value of circularity, and a cross mark represents the standard deviation of circularity.

Referring to FIG. 9, when the restraint start temperature was 150° C. or higher, the average value of circularity was constant. On the other hand, when the restraint start temperature was lower than 150° C., circularity was at least twice poorer. This may be because, when the restraint start temperature was lower than 150° C., the ratio of austenite that transforms to martensite after restraint was started was small and an effect to suppress heat treatment deformation and poor circularity obtained from restraint was insufficient. In addition, referring to FIG. 9, it can be seen that, when the restraint start temperature was set to 250° C., though there is no difference in the average value of circularity, the standard deviation was significantly suppressed and variation in circularity was less.

From the foregoing, it was confirmed that the restraint start temperature is set preferably to 150° C. or higher and more preferably to 250° C. or higher, in order to improve circularity.

(3) Restraint End Temperature (Second Cooling Temperature)

Figure 10:
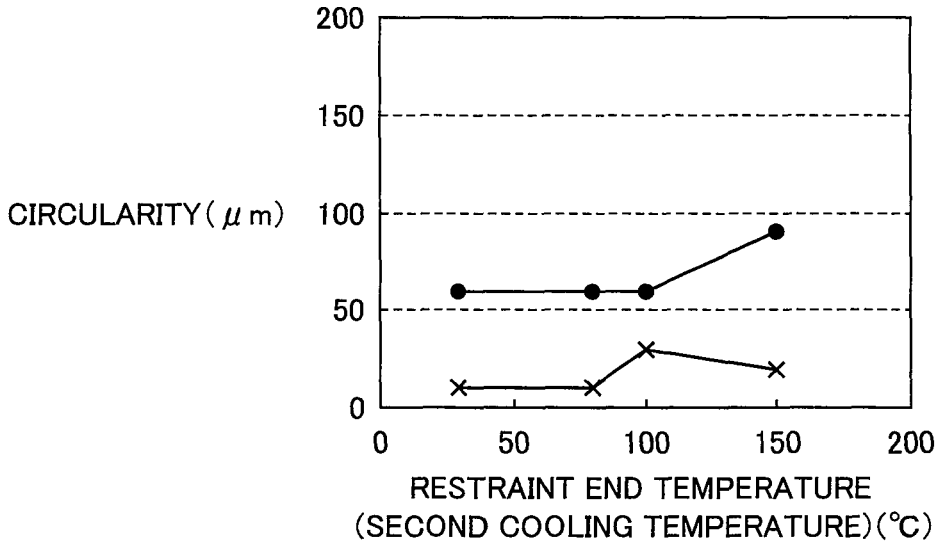
FIG. 10 is a diagram showing relation between a restraint end temperature (second cooling temperature) and circularity.

Referring next to FIG. 10, influence of the restraint end temperature (second cooling temperature) will be described. In FIG. 10, the abscissa represents the restraint end temperature (second cooling temperature), the ordinate represents circularity, a circle represents the average value of circularity, and a cross mark represents the standard deviation of circularity.

Referring to FIG. 10, when the restraint end temperature was 100° C. or lower, the average value of circularity was constant. On the other hand, when the restraint end temperature exceeds 100° C., circularity was significantly poorer. This may be because, when restraint of the annular member ends at the temperature higher than 100° C., the ratio of austenite that newly transforms to martensite during subsequent cooling was great and heat treatment deformation and deterioration of circularity were caused during subsequent cooling. In addition, referring to FIG. 10, it can be seen that, when the restraint end temperature was set to 80° C. or lower, though there was no difference in the average value of circularity, the standard deviation was significantly suppressed and variation in circularity was less.

From the foregoing, it was confirmed that the restraint end temperature is set preferably to 100° C. or lower and more preferably to 80° C. or lower, in order to improve circularity.

(4) Cooling Rate in the Second Cooling Step

Figure 11:
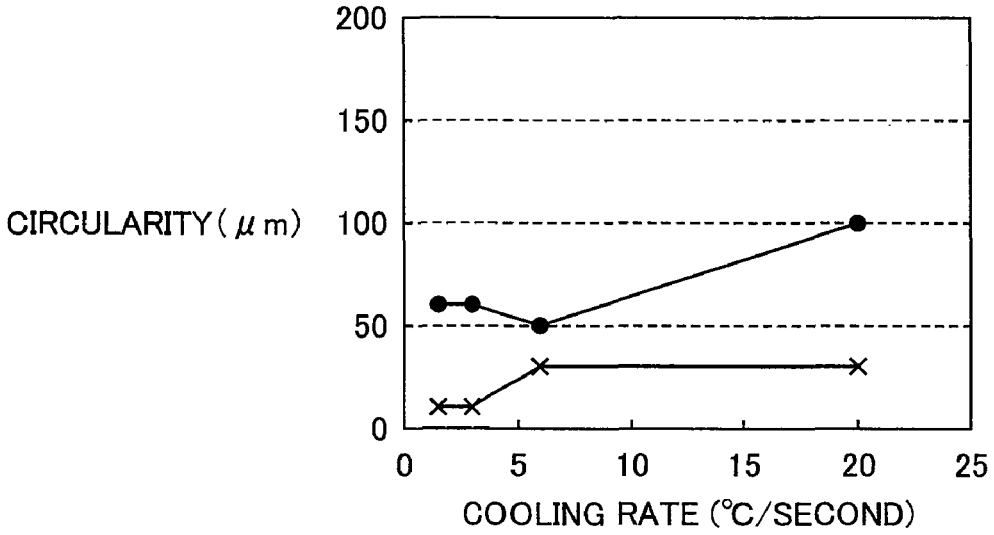
FIG. 11 is a diagram showing relation between a cooling rate in the second cooling step and circularity.

Referring next to FIG. 11, influence of the cooling rate in the second cooling step will be described. In FIG. 11, the abscissa represents the cooling rate in the second cooling step, the ordinate represents circularity, a circle represents the average value of circularity, and a cross mark represents the standard deviation of circularity.

Referring to FIG. 11, when the cooling rate was not higher than 6° C./second, the average value of circularity was substantially constant. On the other hand, when the cooling rate exceeds 6° C./second, circularity was significantly poorer. This may be because, when the annular member was cooled at a cooling rate exceeding 6° C./second, dependency of relation between stress and strain in transformation superplasticity during transformation on the cooling rate became greater. In addition, referring to FIG. 11, it can be seen that, when the cooling rate was set to 3° C./second or lower, though there was no difference in the average value of circularity, the standard deviation was significantly suppressed and variation in circularity was less.

From the foregoing, it was confirmed that the cooling rate in the second cooling step is set preferably to 6° C./second or lower and more preferably to 3° C./second or lower, in order to improve circularity.

(5) Shape of Annular Member

Figure 12:
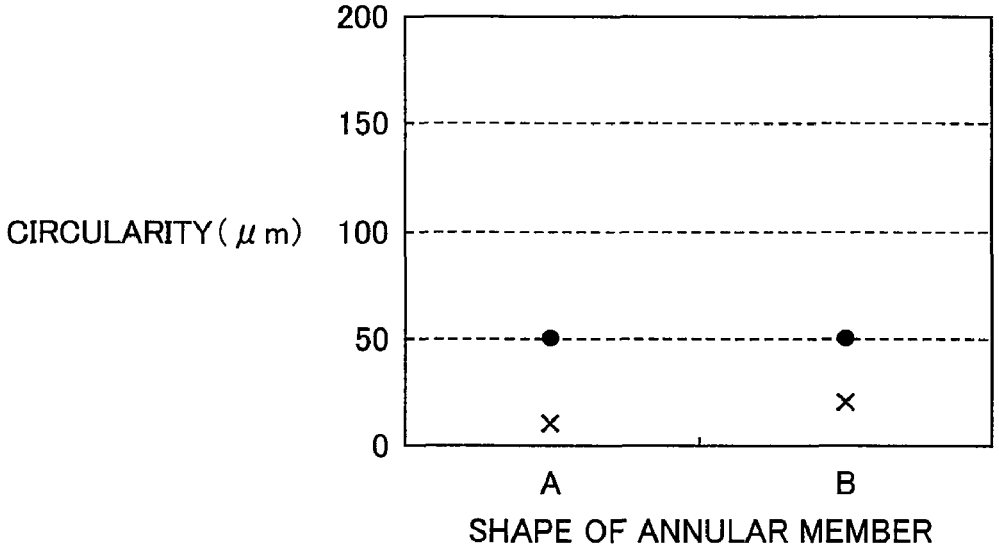
FIG. 12 is a diagram showing relation between a shape of the annular member and circularity.

Referring next to FIG. 12, influence of the shape of the annular member will be described. In FIG. 12, the abscissa represents whether the annular member is in the tapered shape or not (A: tapered shape in FIG. 5, B: non-tapered shape in FIG. 1), the ordinate represents circularity, a circle represents the average value of circularity, and a cross mark represents the standard deviation of circularity.

Referring to FIG. 12, it was found that substantially equal circularity was obtained for annular members in any shape and whether the annular member is in the tapered shape or not hardly affects circularity.

(6) Taper Angle of Lower Restraint Member

Figure 13:
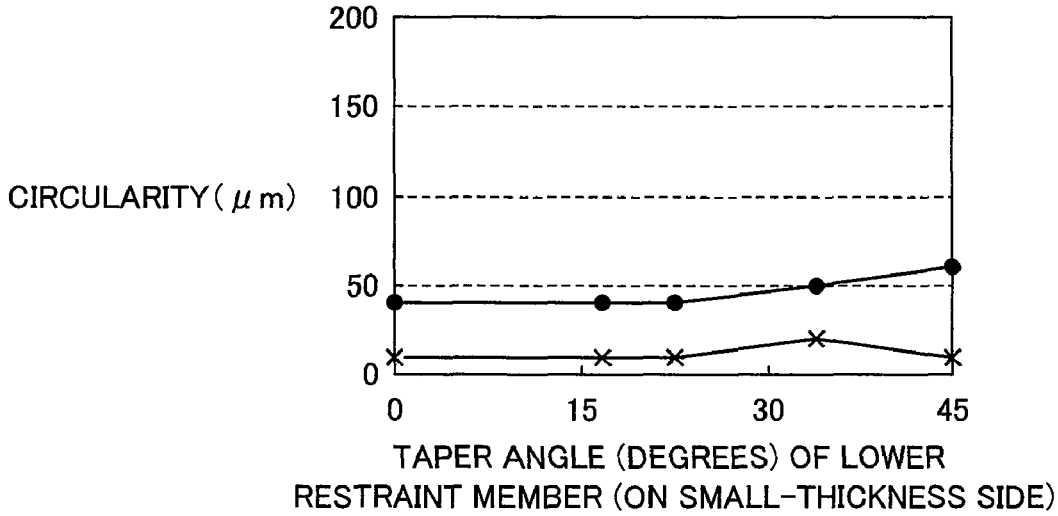
FIG. 13 is a diagram showing relation between a taper angle of a lower restraint member and circularity.

Referring next to FIG. 13, influence of the taper angle of the lower restraint member will be described. In FIG. 13, the abscissa represents the taper angle of the lower restraint member, the ordinate represents circularity, a circle represents the average value of circularity, and a cross mark represents the standard deviation of circularity.

Referring to FIG. 13, it can be considered that, as the taper angle of the lower restraint member is greater, the average value of circularity tends to be slightly greater, however, influence on circularity of the taper angle of the lower restraint member can be said as small, also in consideration of the fact that the standard deviation is substantially constant. In addition, even when the taper angle of the lower restraint member is set to 0 degrees, that is, even when the lower restraint member is in a flat plate shape and the annular member is not restrained in the radial direction, circularity did not get poorer.

From the foregoing, it was confirmed that restraint at the ridgeline portion of the annular member does not necessarily have to be performed at the ridgeline portions adjacent to the end surfaces on both sides, and restraint only on one side can achieve circularity equivalent to that in a case of restraint on both sides.

(7) Restraint Load

Figure 14:
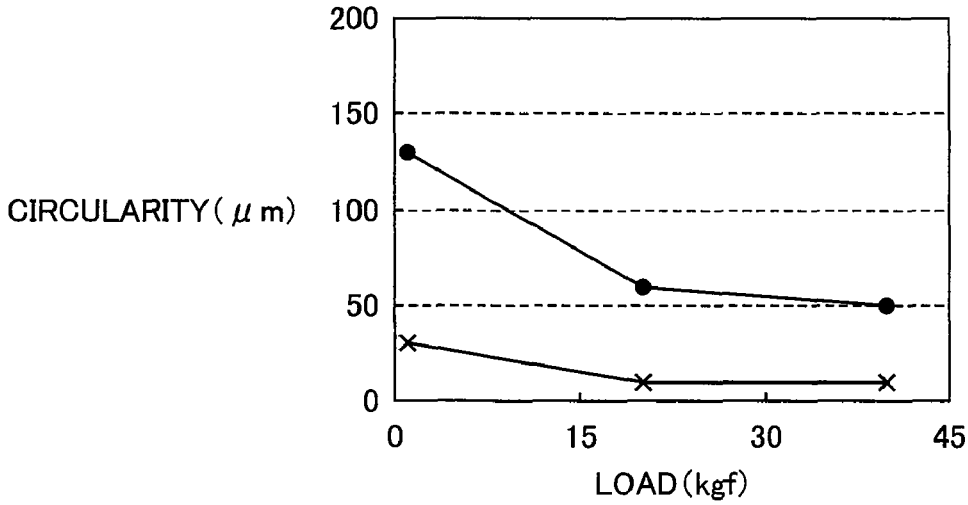
FIG. 14 is a diagram showing relation between a restraint load and circularity.

Referring next to FIG. 14, influence of restraint load will be described. In FIG. 14, the abscissa represents the restraint load (load L applied to load transfer member 34 in FIG. 3), the ordinate represents circularity, a circle represents the average value of circularity, and a cross mark represents the standard deviation of circularity.

Referring to FIG. 14, when the restraint load was 20 kgf or greater, circularity was substantially constant. On the other hand, when the restraint load was smaller than 20 kgf, circularity was significantly poorer. Therefore, it seems that restraint load is preferably not smaller than 20 kgf so long as the annular member is shaped as above.

Here, under such a quenching condition that the cooling rate in the first cooling step is sufficient and the annular member is evenly quench-hardened from a surface to the inside, the annular member is evenly cooled from the surface to the inside. Therefore, it seems that relations described in (1) to (6) above are satisfied regardless of a size and a shape of the annular member. Relation between restraint load and circularity described in (7), however, may be dependent on a size and a shape of the annular member. Therefore, relation between restraint load and circularity was studied in detail separately in an Example 2 below.

Example 2

Example 2 according to the present invention will be described hereinafter. Analysis for studying restraint load necessary for obtaining desired circularity was conducted. An analysis method will be described hereinafter.

Figure 15:
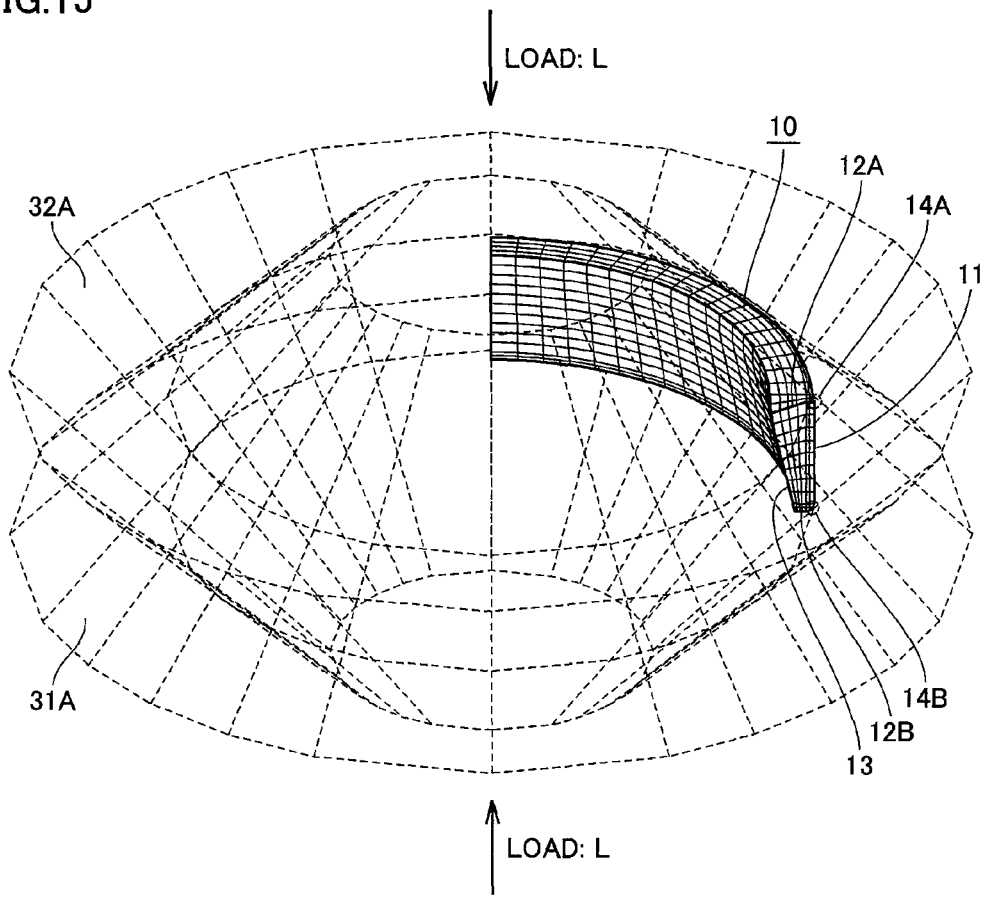
FIG. 15 is a diagram showing a three-dimensional FEM analysis model of the annular member in FIG. 5.

Initially, a three-dimensional FEM (Finite Element Method) analysis model was created for the annular members described in connection with FIGS. 1 and 5. Referring to FIG. 15, the three-dimensional FEM analysis model of the annular member in FIG. 5 is a model in which the annular member in FIG. 5 was restrained with restrained cooling apparatus 20 described in connection with FIG. 3 under load L. In addition, a model in which the annular member in FIG. 1 was restrained with restrained cooling apparatus 20 in connection with FIG. 3 under load L was also created as in FIG. 15. Here, lower restraint member taper angle $\theta_1$ and upper restraint member taper angle $\theta_2$ were both set to 45 degrees. Moreover, the annular member in the analysis model was given in advance oval deformation of circularity of 150 μm.

Then, relation between stress σ and strain ϵ (σ-ϵ diagram) in transformation superplasticity during progress of martensitic transformation was derived through FEM analysis, so as to comply with relation between restraint load and the average value of circularity in the test results in Example 1 described above. Consequently, relation between stress σ and strain ϵ shown in Equation (5) below was obtained. It is noted that a Young's modulus of the annular member was set to 210 GPa.

$$\sigma=1.4\times10^{7}+2\times10^{10}\epsilon^{p} \quad (5)$$

where σ represents stress (Pa) and $\epsilon^p$ represents equivalent plastic strain.

Circularity in cases where the annular members having various shapes and sizes were restrained under various restraint loads was calculated by using this relation of σ-ϵ. Table 2 shows conditions for analysis and circularity after restraint ends (after quenching treatment ends), obtained as a result of analysis.

TABLE 2

| Conditions for Analysis | | | | | Result of |
|---|---|---|---|---|---|
| Annular Member Taper Angle (degree) | Maximum Thickness (mm) | Outer Diameter (mm) | Circularity Before Restraint (μm) | Restraint Load (kgf) | Analysis Circularity After Restraint (μm) |
| 10 | 4.64 | 60 | 100 | 50 | 47 |
| 10 | 4.64 | 60 | 100 | 250 | 22 |
| 10 | 4.64 | 60 | 200 | 50 | 73 |
| 10 | 4.64 | 60 | 200 | 250 | 44 |
| 10 | 4.64 | 100 | 100 | 50 | 62 |

TABLE 2-continued

| Conditions for Analysis | | | | | Result of |
|---|---|---|---|---|---|
| Annular Member Taper Angle (degree) | Maximum Thickness (mm) | Outer Diameter (mm) | Circularity Before Restraint (μm) | Restraint Load (kgf) | Analysis Circularity After Restraint (μm) |
| 10 | 4.64 | 100 | 100 | 250 | 19 |
| 10 | 4.64 | 100 | 200 | 50 | 84 |
| 10 | 4.64 | 100 | 200 | 250 | 35 |
| 30 | 10.661 | 60 | 100 | 50 | 80 |
| 30 | 10.661 | 60 | 100 | 250 | 36 |
| 30 | 10.661 | 60 | 200 | 50 | 179 |
| 30 | 10.661 | 60 | 200 | 250 | 72 |
| 30 | 10.661 | 100 | 100 | 50 | 57 |
| 30 | 10.661 | 100 | 100 | 250 | 34 |
| 30 | 10.661 | 100 | 200 | 50 | 102 |
| 30 | 10.661 | 100 | 200 | 250 | 54 |
| 10 | 10.661 | 60 | 100 | 50 | 100 |
| 10 | 10.661 | 60 | 100 | 250 | 41 |
| 10 | 10.661 | 60 | 200 | 50 | 202 |
| 10 | 10.661 | 60 | 200 | 250 | 79 |
| 10 | 10.661 | 100 | 100 | 50 | 76 |
| 10 | 10.661 | 100 | 100 | 250 | 42 |
| 10 | 10.661 | 100 | 200 | 50 | 175 |
| 10 | 10.661 | 100 | 200 | 250 | 65 |

The result in Table 2 was subjected to regression analysis, and the following Equation (6) was obtained:

$$L/S=3.175\times(C_2/C_1)^{-1.754} \quad (6)$$

where L represents a load (N), S represents a cross-sectional area ($mm^2$) of one cross-section of two separated cross-sections in a cross-section of the annular member including the axis, $C_1$ represents circularity (μm) of the annular member before restraint, and $C_2$ represents circularity (μm) of the annular member required after quenching.

Equation (1) below is obtained based on this Equation (6). Then, assuming $C_2$ as circularity (μm) of the annular member required after quenching, that is, desired circularity, the desired circularity is obtained as a result of application of load not lower than load L calculated in Equation (1).

$$L=3.175\times(C_2/C_1)^{-1.754}\times S \quad (1)$$

Example 3

An Example 3 according to the present invention will be described hereinafter. Tests for examining influence of the restraint member taper angle on leaning deformation were conducted. A test method will be described hereinafter.

Referring to FIGS. 5 and 8, in the test method as in Example 1, an amount of leaning representing a degree of leaning deformation of the annular member when upper restraint member taper angle α was set to a constant value of 45° and lower restraint member taper angle β (the small-thickness side taper angle representing the taper angle of the restraint member in contact with small-thickness side ridge-line portion 14B) was varied from 0° to 45° was measured. For the purpose of comparison, in the test method described above, the amount of leaning was measured similarly for a sample where restraint with the restraint member was not applied (free quenching). Here, the amount of leaning is defined in Equation (7) below.

(amount of leaning)={(average value of outer diameter at large-thickness side end surface)−(average value of outer diameter at small-thickness side end surface)}/2 (7)

Figure 16:
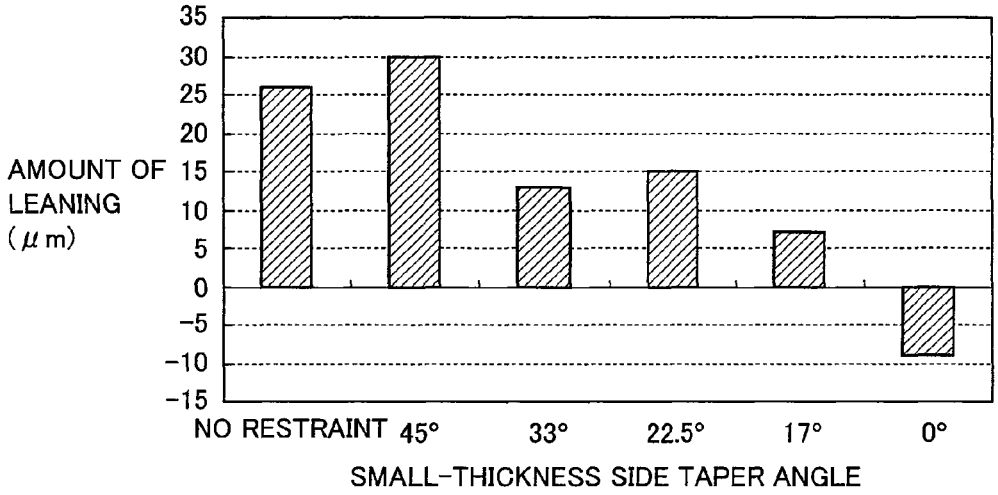
FIG. 16 is a diagram showing a test result in Example 3.

Referring next to FIG. 16, the test result will be described. FIG. 16 shows an amount of leaning for each small-thickness side taper angle and for free quenching.

Referring to FIG. 16, it is confirmed that, as the small-thickness side taper angle is smaller, the amount of leaning tends to be smaller. In addition, it can be seen that, when the small-thickness side taper angle was set to 0°, the amount of leaning attained to a negative value, and the average value of the outer diameter at the small-thickness side end surface was greater than the average value of the outer diameter at the large-thickness side end surface. Moreover, when the small-thickness side taper angle was set to 17°, the absolute value of the amount of leaning was smallest.

Here, as described previously, in the method of restrained-quenching of the annular member according to the present invention, ideally, upper restraint member taper angle α and lower restraint member taper angle β and thicknesses a and b in the radial direction at large-thickness side end surface 12A and small-thickness side end surface 12B of bearing ring 10 satisfy relation in Equation (3) below.

$$(b/a)=(\sin\beta/\sin\alpha) \quad (3)$$

In the present example, a=5.95 mm, b=2.4 mm, and α=45°. Therefore, based on Equation (3), ideally, β=16.5°. Here, referring to FIG. 16, according to the test result in the present example, when the small-thickness side taper angle, that is, lower restraint member taper angle β, is set to 17°, the absolute value of the amount of leaning is smallest. An effect of suppression of leaning deformation obtained by the method of restrained-quenching of the annular member according to the present invention was thus confirmed.

It should be understood that the embodiments and examples disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The method of restrained-quenching of the annular member according to the present invention is particularly advantageously applicable to a method of restrained-quenching of an annular member, that suppresses deformation by restraining an annular member made of steel.

The invention claimed is:

1. A method of restrained-quenching of an annular member, comprising the steps of:

heating an annular member made of steel to a temperature not lower than an $A_1$ point;

cooling said annular member heated to the temperature not lower than the $A_1$ point, from the temperature not lower than the $A_1$ point to a first cooling temperature which is a temperature not higher than an $M_S$ point without restraining said annular member;

restraining said annular member cooled to said first cooling temperature with a restraint member; and cooling said annular member restrained with said restraint member to a second cooling temperature which is a temperature lower than a restraint start temperature at which restraint with said restraint member is started and not higher than the $M_S$ point, while said annular member remains restrained with said restraint member, and in said step of restraining said annular member and said step of cooling said annular member to said second cooling temperature, said annular member being restrained such that said restraint member and said annular member are in contact with each other at a ridgeline portion which is a portion where an outer circumferential surface and at least one end surface out of one end surface and an other end surface of said annular member intersect with each other, without said annular member and said restraint member being in contact with each other at said at least one end surface and at said outer circumferential surface of said annular member.

2. The method of restrained-quenching of an annular member according to claim 1, wherein said restraint start temperature is not lower than 150° C.

3. The method of restrained-quenching of an annular member according to claim 1, wherein said second cooling temperature is not higher than 100° C.

4. The method of restrained-quenching of an annular member according to claim 1, wherein a cooling rate in said step of cooling said annular member to said second cooling temperature is not higher than 6° C./second.

5. The method of restrained-quenching of an annular member according to claim 1, wherein in said step of restraining said annular member with said restraint member and said step of cooling said annular member to said second cooling temperature, said annular member is restrained with said restraint member having a restraint member taper angle not smaller than 44.5 degrees and not greater than 45.5 degrees under load not lower than load L satisfying relation of $$L=3.175\times(C_2/C_1)^{-1.754}\times S \quad (1)$$

where L represents a load (N), S represents a cross-sectional area ($mm^2$) of one cross-section of two separated cross-sections in a cross-section of the annular member including an axis, $C_1$ represents circularity (μm) of the annular member before restraint, and $C_2$ represents circularity (μm) of the annular member required after quenching.

6. The method of restrained-quenching of an annular member according to claim 1, wherein said restraint start temperature is a temperature not higher than the $M_S$ point, and in said step of restraining said annular member with said restraint member and said step of cooling said annular member to said second cooling temperature, said annular member is restrained such that said restraint member and said annular member are in contact with each other at a ridgeline portion which is a portion where the outer circumferential surface and said one end surface of said annular member intersect with each other and said annular member and said restraint member are in contact with each other at said other end surface, without said annular member and said restraint member being in contact with each other at the outer circumferential surface and said one end surface of said annular member.

7. The method of restrained-quenching of an annular member according to claim 6, wherein said annular member has such a tapered shape that a thickness in a radial direction is different in an axial direction, and in said step of restraining said annular member with said restraint member and said step of cooling said annular member to said second cooling temperature, said annular member is restrained with the end surface of said annular member on a side greater in said thickness being defined as said one end surface and the end surface on a side smaller in said thickness being defined as said other end surface.

8. The method of restrained-quenching of an annular member according to claim 6, wherein said restraint start temperature is not lower than 150° C.

9. The method of restrained-quenching of an annular member according to claim 6, wherein said second cooling temperature is not higher than 100° C.

10. The method of restrained-quenching of an annular member according to claim 6, wherein a cooling rate in said step of cooling said annular member to said second cooling temperature is not higher than 6° C./second.

11. The method of restrained-quenching of an annular member according to claim 1, wherein said restraint start temperature is a temperature not higher than the $M_S$ point, and in said step of restraining said annular member with said restraint member and said step of cooling said annular member to said second cooling temperature, said annular member is restrained such that said restraint member and said annular member are in contact with each other at two ridgeline portions which are portions where the outer circumferential surface and two end surfaces of said annular member intersect with each other, without said annular member and said restraint member being in contact with each other at said outer circumferential surface and said two end surfaces of said annular member, and such that a restraint member taper angle and a thickness in a radial direction at said two end surfaces of said annular member satisfy relation of $$0.9\times(b/a)\leqq(\sin\beta/\sin\alpha)\leqq1.1\times(b/a) \quad (2)$$

where α and β represent restraint member taper angles on a side of one end surface and a side of the other end surface out of said two end surfaces of the annular member respectively, and a and b represent thicknesses in the radial direction at said one end surface and said other end surface out of said two end surfaces of the annular member respectively.

12. The method of restrained-quenching of an annular member according to claim 11, wherein said restraint start temperature is not lower than 150° C.

13. The method of restrained-quenching of an annular member according to claim 11, wherein said second cooling temperature is not higher than 100° C.

14. The method of restrained-quenching of an annular member according to claim 11, wherein a cooling rate in said step of cooling said annular member to said second cooling temperature is not higher than 6° C./second.

* * * * *